US011660621B2

(12) United States Patent
Walker et al.

(10) Patent No.: US 11,660,621 B2
(45) Date of Patent: May 30, 2023

(54) REDUCED PRECIPITATION RATE NOZZLE

(71) Applicant: Rain Bird Corporation, Azusa, CA (US)

(72) Inventors: Samuel C. Walker, Green Valley, AZ (US); John James Wlassich, Pasadena, CA (US); Lee James Shadbolt, Tucson, AZ (US); David Eugene Robertson, Glendora, CA (US)

(73) Assignee: Rain Bird Corporation, Azusa, CA (US)

( * ) Notice: Subject to any disclaimer, the term of this patent is extended or adjusted under 35 U.S.C. 154(b) by 19 days.

(21) Appl. No.: 17/370,571

(22) Filed: Jul. 8, 2021

(65) Prior Publication Data

US 2021/0331185 A1 Oct. 28, 2021

Related U.S. Application Data

(62) Division of application No. 16/692,868, filed on Nov. 22, 2019, now Pat. No. 11,247,219.

(51) Int. Cl.
*B05B 1/26* (2006.01)
*B05B 15/74* (2018.01)

(52) U.S. Cl.
CPC ..... *B05B 1/265* (2013.01); *B05B 15/74* (2018.02)

(58) Field of Classification Search
CPC ..... B05B 1/265; B05B 15/74
USPC ..... 239/498, 518, 521–524
See application file for complete search history.

(56) References Cited

U.S. PATENT DOCUMENTS

| | | | |
|---|---|---|---|
| 201,009 | A | 3/1878 | Hastings |
| 458,607 | A | 9/1891 | Weiss |
| 691,758 | A | 1/1902 | Gay |
| 949,520 | A | 2/1910 | Choate |
| 1,432,386 | A | 10/1922 | Ctjkwey |
| 1,523,609 | A | 1/1925 | Roach |
| 1,639,162 | A | 8/1927 | Brooks |
| 1,764,570 | A | 6/1930 | Lohman |
| 1,805,782 | A | 5/1931 | Munz |

(Continued)

FOREIGN PATENT DOCUMENTS

| | | |
|---|---|---|
| AU | 783999 | 1/2006 |
| CA | 2427450 | 6/2004 |

(Continued)

OTHER PUBLICATIONS

USPTO; U.S. Appl. No. 16/692,868; Office Action dated Jun. 28, 2021; (pp. 1-6).

(Continued)

*Primary Examiner* — Christopher S Kim
(74) *Attorney, Agent, or Firm* — Fitch, Even, Tabin & Flannery, LLP

(57) ABSTRACT

A nozzle is provided having a low precipitation rate and uniform fluid distribution to a desired arcuate span of coverage. The nozzle has an inflow port having a shape corresponding to the desired arc of coverage and a size for effecting a low precipitation rate. The nozzle also has a deflector surface with a water distribution profile including ribs for subdividing the fluid into multiple sets of fluid streams. There are at least two fluid streams for distant and close-in irrigation to provide relatively uniform distribution and coverage. The nozzle may be a unitary, one-piece, molded nozzle body including a mounting portion, an inflow port, and a deflector portion.

16 Claims, 11 Drawing Sheets

(56) References Cited

U.S. PATENT DOCUMENTS

| | | | |
|---|---|---|---|
| 2,075,589 | A | 3/1937 | Munz |
| 2,125,863 | A | 8/1938 | Arbogast |
| 2,125,978 | A | 8/1938 | Arbogast |
| 2,128,552 | A | 8/1938 | Rader |
| 2,130,810 | A | 9/1938 | Munz |
| 2,325,280 | A | 7/1943 | Scherrer |
| 2,338,273 | A | 1/1944 | Wilkins |
| 2,348,776 | A | 5/1944 | Bentley |
| 2,634,163 | A | 4/1953 | Double |
| 2,723,879 | A | 11/1955 | Martin |
| 2,785,013 | A | 3/1957 | Stearns |
| 2,864,652 | A | 12/1958 | O'Brien |
| 2,875,783 | A | 3/1959 | Schippers |
| 2,914,257 | A | 11/1959 | Wiant |
| 2,935,266 | A | 5/1960 | Coleondro |
| 2,990,123 | A | 6/1961 | Hyde |
| 2,990,128 | A | 6/1961 | Knutsen |
| 3,029,030 | A | 4/1962 | Dey, Sr. |
| 3,109,591 | A | 11/1963 | Moen |
| 3,239,149 | A | 3/1966 | Lindberg, Jr. |
| 3,365,137 | A | 1/1968 | Corsette |
| 3,380,659 | A | 4/1968 | Seablom |
| 3,716,192 | A | 2/1973 | Hunter |
| 3,752,403 | A | 8/1973 | Van Diest |
| 3,815,831 | A | 6/1974 | Jooste |
| 3,940,066 | A | 2/1976 | Hunter |
| 3,948,285 | A | 4/1976 | Flynn |
| 3,955,764 | A | 5/1976 | Phaup |
| 4,026,471 | A | 5/1977 | Hunter |
| 4,119,275 | A | 10/1978 | Hunter |
| 4,131,234 | A | 12/1978 | Pescetto |
| 4,168,033 | A | 9/1979 | Von Bernuth |
| 4,189,099 | A | 2/1980 | Bruninga |
| 4,198,000 | A | 4/1980 | Hunter |
| 4,253,608 | A | 3/1981 | Hunter |
| 4,272,024 | A | 6/1981 | Kah |
| 4,316,579 | A | 2/1982 | Ray |
| 4,353,506 | A | 10/1982 | Hayes |
| 4,353,507 | A | 10/1982 | Kah |
| 4,398,666 | A | 8/1983 | Hunter |
| 4,401,273 | A | 8/1983 | Olson |
| 4,417,691 | A | 11/1983 | Lockwood |
| 4,456,181 | A | 6/1984 | Burnham |
| 4,471,908 | A | 9/1984 | Hunter |
| 4,479,611 | A | 10/1984 | Galvis |
| 4,501,391 | A | 2/1985 | Hunter |
| 4,566,632 | A | 1/1986 | Sesser |
| 4,568,024 | A | 2/1986 | Hunter |
| 4,579,284 | A | 4/1986 | Arnold |
| 4,579,285 | A | 4/1986 | Hunter |
| 4,609,146 | A | 9/1986 | Walto |
| 4,618,100 | A | 10/1986 | White |
| 4,624,412 | A | 11/1986 | Hunter |
| 4,625,917 | A | 12/1986 | Torney |
| RE32,386 | E | 3/1987 | Hunter |
| 4,660,766 | A | 4/1987 | Nelson |
| 4,669,663 | A | 6/1987 | Meyer |
| 4,676,438 | A | 6/1987 | Sesser |
| 4,681,260 | A | 7/1987 | Cochran |
| 4,681,263 | A | 7/1987 | Cockman |
| 4,682,732 | A | 7/1987 | Walto |
| 4,699,321 | A | 10/1987 | Bivens |
| 4,708,291 | A | 11/1987 | Grundy |
| 4,718,605 | A | 1/1988 | Hunter |
| 4,720,045 | A | 1/1988 | Meyer |
| 4,739,394 | A | 4/1988 | Oda |
| 4,739,934 | A | 4/1988 | Gewelber |
| D296,464 | S | 6/1988 | Marmol |
| 4,752,031 | A | 6/1988 | Merrick |
| 4,760,958 | A | 8/1988 | Greenberg |
| 4,763,838 | A | 8/1988 | Holcomb |
| 4,784,325 | A | 11/1988 | Walker |
| 4,796,809 | A | 1/1989 | Hunter |
| 4,796,811 | A | 1/1989 | Davisson |
| 4,815,662 | A | 3/1989 | Hunter |
| 4,834,289 | A | 5/1989 | Hunter |
| 4,836,449 | A | 6/1989 | Hunter |
| 4,836,450 | A | 6/1989 | Hunter |
| 4,840,312 | A | 6/1989 | Tyler |
| 4,842,201 | A | 6/1989 | Hunter |
| 4,867,378 | A | 9/1989 | Kah |
| 4,889,287 | A | 12/1989 | Hemsley |
| 4,898,332 | A | 2/1990 | Hunter |
| 4,901,924 | A | 2/1990 | Kah |
| 4,932,590 | A | 6/1990 | Hunter |
| 4,944,456 | A | 7/1990 | Zakai |
| 4,948,052 | A | 8/1990 | Hunter |
| 4,955,542 | A | 9/1990 | Kah |
| 4,961,534 | A | 10/1990 | Tyler |
| 4,967,961 | A | 11/1990 | Hunter |
| 4,971,250 | A | 11/1990 | Hunter |
| D312,865 | S | 12/1990 | Davisson |
| 4,986,474 | A | 1/1991 | Schisler |
| 5,031,840 | A | 7/1991 | Grundy |
| 5,050,800 | A | 9/1991 | Lamar |
| 5,052,621 | A | 10/1991 | Katzer |
| 5,058,806 | A | 10/1991 | Rupar |
| 5,078,321 | A | 1/1992 | Davis |
| 5,083,709 | A | 1/1992 | Iwanowski |
| RE33,823 | E | 2/1992 | Nelson |
| 5,086,977 | A | 2/1992 | Kah |
| 5,090,619 | A | 2/1992 | Barthold |
| 5,098,021 | A | 3/1992 | Kah |
| 5,104,045 | A | 4/1992 | Kah |
| 5,123,597 | A | 6/1992 | Bendall |
| 5,141,024 | A | 8/1992 | Hicks |
| 5,148,990 | A | 9/1992 | Kah |
| 5,148,991 | A | 9/1992 | Kah |
| 5,152,458 | A | 10/1992 | Curtis |
| 5,158,232 | A | 10/1992 | Tyler |
| 5,174,327 | A | 12/1992 | Truax |
| 5,174,501 | A | 12/1992 | Hadar |
| 5,199,646 | A | 4/1993 | Kah |
| 5,205,491 | A | 4/1993 | Hadar |
| 5,224,653 | A | 7/1993 | Nelson |
| 5,226,599 | A | 7/1993 | Lindermeir |
| 5,226,602 | A | 7/1993 | Cochran |
| 5,234,169 | A | 8/1993 | McKenzie |
| 5,240,182 | A | 8/1993 | Lemme |
| 5,240,184 | A | 8/1993 | Lawson |
| 5,267,689 | A | 12/1993 | Forer |
| 5,288,022 | A | 2/1994 | Sesser |
| 5,299,742 | A | 4/1994 | Han |
| 5,322,223 | A | 6/1994 | Hadar |
| 5,335,857 | A | 8/1994 | Hagon |
| 5,360,167 | A | 11/1994 | Grundy |
| 5,370,311 | A | 12/1994 | Chen |
| 5,372,307 | A | 12/1994 | Sesser |
| 5,375,768 | A | 12/1994 | Clark |
| 5,398,872 | A | 3/1995 | Joubran |
| 5,417,370 | A | 5/1995 | Kah |
| 5,423,486 | A | 6/1995 | Hunter |
| 5,435,490 | A | 7/1995 | Machut |
| 5,439,174 | A | 8/1995 | Sweet |
| RE35,037 | E | 9/1995 | Kah |
| 5,456,411 | A | 10/1995 | Scott |
| 5,503,139 | A | 4/1996 | McMahon |
| 5,526,982 | A | 6/1996 | McKenzie |
| 5,544,814 | A | 8/1996 | Spenser |
| 5,556,036 | A | 9/1996 | Chase |
| 5,588,594 | A | 12/1996 | Kah |
| 5,588,595 | A | 12/1996 | Sweet |
| 5,598,977 | A | 2/1997 | Lemme |
| 5,611,488 | A | 3/1997 | Frolich |
| 5,620,141 | A | 4/1997 | Chiang |
| 5,640,983 | A | 6/1997 | Sherman |
| 5,642,861 | A | 7/1997 | Ogi |
| 5,653,390 | A | 8/1997 | Kah |
| 5,662,545 | A | 9/1997 | Zimmerman |
| 5,671,885 | A | 9/1997 | Davisson |
| 5,671,886 | A | 9/1997 | Sesser |
| 5,676,315 | A | 10/1997 | Han |
| D388,502 | S | 12/1997 | Kah |
| 5,695,123 | A | 12/1997 | Van Le |

(56) References Cited

U.S. PATENT DOCUMENTS

| | | | |
|---|---|---|---|
| 5,699,962 | A | 12/1997 | Scott |
| 5,711,486 | A | 1/1998 | Clark |
| 5,718,381 | A | 2/1998 | Katzer |
| 5,720,435 | A | 2/1998 | Hunter |
| 5,722,593 | A | 3/1998 | McKenzie |
| 5,758,827 | A | 6/1998 | Van Le |
| 5,762,270 | A | 6/1998 | Kearby |
| 5,765,757 | A | 6/1998 | Bendall |
| 5,765,760 | A | 6/1998 | Kuo |
| 5,769,322 | A | 6/1998 | Smith |
| 5,785,248 | A | 7/1998 | Staylor |
| 5,820,029 | A | 10/1998 | Marans |
| 5,823,439 | A | 10/1998 | Hunter |
| 5,823,440 | A | 10/1998 | Clark |
| 5,826,797 | A | 10/1998 | Kah |
| 5,845,849 | A | 12/1998 | Mitzlaff |
| 5,875,969 | A | 3/1999 | Grundy |
| 5,918,812 | A | 7/1999 | Beutler |
| 5,927,607 | A | 7/1999 | Scott |
| 5,971,297 | A | 10/1999 | Sesser |
| 5,988,523 | A | 11/1999 | Scott |
| 5,992,760 | A | 11/1999 | Kearby |
| 6,007,001 | A | 12/1999 | Hilton |
| 6,019,295 | A | 2/2000 | McKenzie |
| 6,029,907 | A | 2/2000 | McKenzie |
| 6,042,021 | A | 3/2000 | Clark |
| 6,050,502 | A | 4/2000 | Clark |
| 6,076,744 | A | 6/2000 | O'Brien |
| 6,076,747 | A | 6/2000 | Ming-Yuan |
| 6,085,995 | A | 7/2000 | Kah |
| 6,102,308 | A | 8/2000 | Steingass |
| 6,109,545 | A | 8/2000 | Kah |
| 6,138,924 | A | 10/2000 | Hunter |
| 6,145,758 | A | 11/2000 | Ogi |
| 6,155,493 | A | 12/2000 | Kearby |
| 6,158,675 | A | 12/2000 | Ogi |
| 6,182,909 | B1 | 2/2001 | Kah |
| 6,186,413 | B1 | 2/2001 | Lawson |
| 6,223,999 | B1 | 5/2001 | Lemelshtrich |
| 6,227,455 | B1 | 5/2001 | Scott |
| 6,230,988 | B1 | 5/2001 | Chao |
| 6,230,989 | B1 | 5/2001 | Haverstraw |
| 6,237,862 | B1 | 5/2001 | Kah |
| 6,241,158 | B1 | 6/2001 | Clark |
| 6,244,521 | B1 | 6/2001 | Sesser |
| 6,264,117 | B1 | 7/2001 | Roman |
| 6,286,767 | B1 | 9/2001 | Hui-Chen |
| 6,332,581 | B1 | 12/2001 | Chin |
| 6,336,597 | B1 | 1/2002 | Kah |
| 6,341,733 | B1 | 1/2002 | Sweet |
| 6,345,541 | B1 | 2/2002 | Hendey |
| 6,367,708 | B1 | 4/2002 | Olson |
| D458,342 | S | 6/2002 | Johnson |
| 6,443,372 | B1 | 9/2002 | Hsu |
| 6,454,186 | B2 | 9/2002 | Haverstraw |
| 6,457,656 | B1 | 10/2002 | Scott |
| 6,464,151 | B1 | 10/2002 | Cordua |
| 6,478,237 | B2 | 11/2002 | Kearby |
| 6,488,218 | B1 | 12/2002 | Townsend |
| 6,491,235 | B1 | 12/2002 | Scott |
| 6,494,384 | B1 | 12/2002 | Meyer |
| 6,499,672 | B1 | 12/2002 | Sesser |
| 6,530,531 | B2 | 3/2003 | Butler |
| 6,588,680 | B2 | 7/2003 | Cameron |
| 6,601,781 | B2 | 8/2003 | Kah |
| 6,607,147 | B2 | 8/2003 | Schneider |
| 6,622,940 | B2 | 9/2003 | Huang |
| 6,637,672 | B2 | 10/2003 | Cordua |
| 6,651,904 | B2 | 11/2003 | Roman |
| 6,651,905 | B2 | 11/2003 | Sesser |
| 6,688,539 | B2 | 2/2004 | Vander Griend |
| 6,695,223 | B2 | 2/2004 | Beutler |
| 6,715,699 | B1 | 4/2004 | Greenberg |
| 6,719,218 | B2 | 4/2004 | Cool |
| 6,732,952 | B2 | 5/2004 | Kah |
| 6,736,332 | B2 | 5/2004 | Sesser |
| 6,736,336 | B2 | 5/2004 | Wong |
| 6,737,332 | B1 | 5/2004 | Fuselier |
| 6,769,633 | B1 | 8/2004 | Huang |
| 6,811,098 | B2 | 11/2004 | Drechsel |
| 6,814,304 | B2 | 11/2004 | Onofrio |
| 6,814,305 | B2 | 11/2004 | Townsend |
| 6,817,543 | B2 | 11/2004 | Clark |
| 6,820,825 | B1 | 11/2004 | Wang |
| 6,827,291 | B2 | 12/2004 | Townsend |
| 6,834,816 | B2 | 12/2004 | Kah, Jr. |
| 6,840,460 | B2 | 1/2005 | Clark |
| 6,848,632 | B2 | 2/2005 | Clark |
| 6,854,664 | B2 | 2/2005 | Smith |
| 6,869,026 | B2 | 3/2005 | McKenzie |
| 6,871,795 | B2 | 3/2005 | Anuskiewicz |
| 6,880,768 | B2 | 4/2005 | Lau |
| 6,883,727 | B2 | 4/2005 | De Los Santos |
| 6,921,030 | B2 | 7/2005 | Renquist |
| 6,932,279 | B2 | 8/2005 | Burcham |
| 6,942,164 | B2 | 9/2005 | Walker |
| 6,945,471 | B2 | 9/2005 | McKenzie |
| 6,957,782 | B2 | 10/2005 | Clark |
| 6,997,393 | B1 | 2/2006 | Angold |
| 7,017,831 | B2 | 3/2006 | Santiago |
| 7,017,837 | B2 | 3/2006 | Taketomi |
| 7,028,920 | B2 | 4/2006 | Hekman |
| 7,028,927 | B2 | 4/2006 | Mermet |
| 7,032,836 | B2 | 4/2006 | Sesser |
| 7,032,844 | B2 | 4/2006 | Cordua |
| 7,040,553 | B2 | 5/2006 | Clark |
| 7,044,403 | B2 | 5/2006 | Kah |
| 7,070,122 | B2 | 7/2006 | Burcham |
| 7,090,146 | B1 | 8/2006 | Ericksen |
| 7,100,842 | B2 | 9/2006 | Meyer |
| 7,104,472 | B2 | 9/2006 | Renquist |
| 7,108,204 | B2 | 9/2006 | Johnson |
| 7,111,795 | B2 | 9/2006 | Thong |
| 7,143,957 | B2 | 12/2006 | Nelson |
| 7,143,962 | B2 | 12/2006 | Kah, Jr. |
| 7,152,814 | B1 | 12/2006 | Schapper |
| 7,156,322 | B1 | 1/2007 | Heitzman |
| 7,159,795 | B2 | 1/2007 | Sesser |
| 7,168,634 | B2 | 1/2007 | Onofrio |
| 7,232,081 | B2 | 6/2007 | Kah |
| 7,234,651 | B2 | 6/2007 | Mousavi |
| 7,240,860 | B2 | 7/2007 | Griend |
| 7,287,710 | B1 | 10/2007 | Nelson |
| 7,287,711 | B2 | 10/2007 | Crooks |
| 7,293,721 | B2 | 11/2007 | Roberts |
| 7,303,147 | B1 | 12/2007 | Danner |
| 7,303,153 | B2 | 12/2007 | Han |
| 7,322,533 | B2 | 1/2008 | Grizzle |
| 7,337,988 | B2 | 3/2008 | McCormick |
| 7,389,942 | B2 | 6/2008 | Kenyon |
| RE40,440 | E | 7/2008 | Sesser |
| 7,392,956 | B2 | 7/2008 | McKenzie |
| 7,429,005 | B2 | 9/2008 | Schapper |
| 7,478,526 | B2 | 1/2009 | McAfee |
| 7,487,924 | B2 | 2/2009 | Johnson |
| 7,533,833 | B2 | 5/2009 | Wang |
| 7,562,833 | B2 | 7/2009 | Perkins |
| 7,581,687 | B2 | 9/2009 | Feith |
| 7,584,906 | B2 | 9/2009 | Lev |
| 7,597,273 | B2 | 10/2009 | McAfee |
| 7,597,276 | B2 | 10/2009 | Hawkins |
| 7,607,588 | B2 | 10/2009 | Nobili |
| 7,611,077 | B2 | 11/2009 | Sesser |
| 7,621,467 | B1 | 11/2009 | Garcia |
| 7,654,474 | B2 | 2/2010 | Cordua |
| 7,686,235 | B2 | 3/2010 | Roberts |
| 7,686,236 | B2 | 3/2010 | Alexander |
| 7,703,706 | B2 | 4/2010 | Walker |
| RE41,302 | E | 5/2010 | Drechsel |
| D615,152 | S | 5/2010 | Kah |
| 7,766,259 | B2 | 8/2010 | Feith |
| 7,770,821 | B2 | 8/2010 | Pinch |
| 7,780,093 | B2 | 8/2010 | Johnson |
| D628,272 | S | 11/2010 | Kah |

(56) References Cited

U.S. PATENT DOCUMENTS

| | | | |
|---|---|---|---|
| 7,828,229 | B2 | 11/2010 | Kah |
| 7,850,094 | B2 | 12/2010 | Richmond |
| 7,861,948 | B1 | 1/2011 | Crooks |
| D636,459 | S | 4/2011 | Kah |
| 7,926,746 | B2 | 4/2011 | Melton |
| 7,971,804 | B2 | 7/2011 | Roberts |
| RE42,596 | E | 8/2011 | Sesser |
| 8,006,919 | B2 | 8/2011 | Renquist |
| 8,047,456 | B2 | 11/2011 | Kah |
| 8,056,829 | B2 | 11/2011 | Gregory |
| 8,074,877 | B2 | 12/2011 | Mullen |
| 8,074,897 | B2 | 12/2011 | Hunnicutt |
| 8,205,811 | B2 | 6/2012 | Cordua |
| 8,272,583 | B2 | 9/2012 | Hunnicutt |
| 8,282,022 | B2 | 10/2012 | Porter |
| 8,328,112 | B2 | 12/2012 | Johnson |
| 8,336,788 | B2 | 12/2012 | Perkins |
| 8,651,400 | B2 | 2/2014 | Walker |
| 8,672,242 | B2 | 3/2014 | Hunnicutt |
| 8,695,900 | B2 | 4/2014 | Hunnicutt |
| 8,783,582 | B2 | 7/2014 | Robertson |
| 8,785,382 | B2 | 7/2014 | Kilpatrick |
| 8,789,768 | B2 | 7/2014 | Hunnicutt |
| 8,925,837 | B2 | 1/2015 | Walker |
| 9,079,202 | B2 | 7/2015 | Walker |
| 9,174,227 | B2 | 11/2015 | Robertson |
| 9,314,952 | B2 | 4/2016 | Walker |
| 9,776,195 | B2 | 10/2017 | Russell |
| 2001/0023901 | A1 | 9/2001 | Haverstraw |
| 2002/0070289 | A1 | 6/2002 | Hsu |
| 2002/0130202 | A1 | 9/2002 | Kah |
| 2002/0153434 | A1 | 10/2002 | Cordua |
| 2003/0006304 | A1 | 1/2003 | Cool |
| 2003/0015606 | A1 | 1/2003 | Cordua |
| 2003/0042327 | A1 | 3/2003 | Beutler |
| 2003/0071140 | A1 | 4/2003 | Roman |
| 2003/0075620 | A1 | 4/2003 | Kah, Jr. |
| 2004/0108391 | A1 | 6/2004 | Onofrio |
| 2004/0124261 | A1 | 7/2004 | Griend |
| 2005/0006501 | A1 | 1/2005 | Englefield |
| 2005/0161534 | A1 | 7/2005 | Kah |
| 2005/0194464 | A1 | 9/2005 | Bruninga |
| 2005/0194479 | A1 | 9/2005 | Curtis |
| 2006/0038046 | A1 | 2/2006 | Curtis |
| 2006/0086832 | A1 | 4/2006 | Roberts |
| 2006/0086833 | A1 | 4/2006 | Roberts |
| 2006/0108445 | A1 | 5/2006 | Pinch |
| 2006/0144968 | A1 | 7/2006 | Lev |
| 2006/0237198 | A1 | 10/2006 | Crampton |
| 2006/0273202 | A1 | 12/2006 | Su |
| 2006/0281375 | A1 | 12/2006 | Jordan |
| 2007/0012800 | A1 | 1/2007 | McAfee |
| 2007/0034711 | A1 | 2/2007 | Kah |
| 2007/0034712 | A1 | 2/2007 | Kah |
| 2007/0181711 | A1 | 8/2007 | Sesser |
| 2007/0235565 | A1 | 10/2007 | Kah |
| 2007/0246567 | A1 | 10/2007 | Roberts |
| 2008/0169363 | A1 | 7/2008 | Walker |
| 2008/0217427 | A1 | 9/2008 | Wang |
| 2008/0257982 | A1 | 10/2008 | Kah |
| 2008/0276391 | A1 | 11/2008 | Jung |
| 2008/0277499 | A1 | 11/2008 | McAfee |
| 2009/0008484 | A1 | 1/2009 | Feith |
| 2009/0014559 | A1 | 1/2009 | Marino |
| 2009/0072048 | A1 | 3/2009 | Renquist |
| 2009/0078788 | A1 | 3/2009 | Holmes |
| 2009/0108099 | A1 | 4/2009 | Porter |
| 2009/0140076 | A1 | 6/2009 | Cordua |
| 2009/0173803 | A1 | 7/2009 | Kah |
| 2009/0173904 | A1 | 7/2009 | Roberts |
| 2009/0188988 | A1 | 7/2009 | Walker |
| 2009/0188991 | A1 | 7/2009 | Russell |
| 2009/0224070 | A1 | 9/2009 | Clark |
| 2010/0078508 | A1 | 4/2010 | South |
| 2010/0090024 | A1 | 4/2010 | Hunnicutt |
| 2010/0090036 | A1 | 4/2010 | Allen |
| 2010/0108787 | A1 | 5/2010 | Walker |
| 2010/0155506 | A1 | 6/2010 | Johnson |
| 2010/0176217 | A1 | 7/2010 | Richmond |
| 2010/0257670 | A1 | 10/2010 | Hodel |
| 2010/0276512 | A1 | 11/2010 | Nies |
| 2010/0294851 | A1 | 11/2010 | Johnson |
| 2010/0301135 | A1 | 12/2010 | Hunnicutt |
| 2010/0301142 | A1 | 12/2010 | Hunnicutt |
| 2011/0024522 | A1 | 2/2011 | Anuskiewicz |
| 2011/0024526 | A1 | 2/2011 | Feith |
| 2011/0024809 | A1 | 2/2011 | Janesick |
| 2011/0031325 | A1 | 2/2011 | Perkins |
| 2011/0031332 | A1 | 2/2011 | Sesser |
| 2011/0036920 | A1 | 2/2011 | Johnson |
| 2011/0089250 | A1 | 4/2011 | Zhao |
| 2011/0121097 | A1 | 5/2011 | Walker |
| 2011/0147484 | A1 | 6/2011 | Jahan |
| 2011/0147489 | A1 | 6/2011 | Walker |
| 2011/0248093 | A1 | 10/2011 | Kim |
| 2011/0248094 | A1 | 10/2011 | Robertson |
| 2011/0248097 | A1 | 10/2011 | Kim |
| 2011/0285126 | A1 | 11/2011 | Jahan |
| 2011/0309161 | A1 | 12/2011 | Renquist |
| 2012/0012670 | A1 | 1/2012 | Kah |
| 2012/0061489 | A1 | 3/2012 | Hunnicutt |
| 2012/0153051 | A1 | 6/2012 | Kah |
| 2012/0292403 | A1 | 11/2012 | Hunnicutt |
| 2013/0334332 | A1 | 12/2013 | Robertson |
| 2013/0334340 | A1 | 12/2013 | Walker |
| 2014/0027526 | A1 | 1/2014 | Shadbolt |
| 2014/0027527 | A1 | 1/2014 | Walker |
| 2014/0263757 | A1 | 9/2014 | Walker |

FOREIGN PATENT DOCUMENTS

| | | | |
|---|---|---|---|
| CN | 2794646 | | 7/2006 |
| CN | 2805823 | | 8/2006 |
| DE | 1283591 | B | 11/1968 |
| DE | 3335805 | A1 | 2/1985 |
| EP | 0463742 | | 1/1992 |
| EP | 0489679 | | 6/1992 |
| EP | 0518579 | | 12/1992 |
| EP | 0572747 | | 12/1993 |
| EP | 0646417 | | 4/1995 |
| EP | 0724913 | A2 | 8/1996 |
| EP | 0761312 | | 3/1997 |
| EP | 0761312 | A1 | 12/1997 |
| EP | 1016463 | | 7/2000 |
| EP | 1043077 | | 10/2000 |
| EP | 1043075 | A1 | 11/2000 |
| EP | 1173286 | | 1/2002 |
| EP | 1250958 | | 10/2002 |
| EP | 1270082 | | 1/2003 |
| EP | 1289673 | | 3/2003 |
| EP | 1426112 | | 6/2004 |
| EP | 1440735 | | 7/2004 |
| EP | 1452234 | | 9/2004 |
| EP | 1492626 | | 1/2005 |
| EP | 1502660 | | 2/2005 |
| EP | 1508378 | | 2/2005 |
| EP | 1818104 | | 8/2007 |
| EP | 1944090 | | 7/2008 |
| EP | 2251090 | A2 | 11/2010 |
| EP | 2255884 | A1 | 12/2010 |
| GB | 1234723 | | 6/1971 |
| GB | 2330783 | | 5/1999 |
| SU | 62588 | | 11/1942 |
| WO | 1995020988 | | 8/1995 |
| WO | 1997027951 | | 8/1997 |
| WO | 9735668 | | 10/1997 |
| WO | 2000007428 | | 12/2000 |
| WO | 200131996 | | 5/2001 |
| WO | 2001031996 | | 5/2001 |
| WO | 200162395 | | 8/2001 |
| WO | 2001062395 | | 8/2001 |
| WO | 2002078857 | | 10/2002 |
| WO | 2002098570 | | 12/2002 |
| WO | 2003086643 | | 10/2003 |

(56) References Cited

FOREIGN PATENT DOCUMENTS

| | | |
|---|---|---|
| WO | 2004052721 | 6/2004 |
| WO | 2005099905 | 10/2005 |
| WO | 2005115554 | 12/2005 |
| WO | 2005123263 | 12/2005 |
| WO | 2006108298 | 10/2006 |
| WO | 2007131270 | 11/2007 |
| WO | 2008130393 | 10/2008 |
| WO | 2009036382 | 3/2009 |
| WO | 2010036241 | 4/2010 |
| WO | 2010126769 | 11/2010 |
| WO | 2011075690 | 6/2011 |

OTHER PUBLICATIONS

USPTO; U.S. Appl. No. 16/692,868; Notice of Allowance and Fees Due (PTOL-85) dated Oct. 12, 2021; (pp. 1-5).

REDUCED PRECIPITATION RATE NOZZLE

CROSS-REFERENCE TO RELATED APPLICATION

This application is a divisional application of U.S. application Ser. No. 16/692,868, filed Nov. 22, 2019, which is incorporated by reference herein in its entirety.

FIELD

This invention relates generally to irrigation nozzles and, more particularly, to an irrigation nozzle with a relatively low precipitation rate and uniform fluid distribution.

BACKGROUND

Efficient irrigation is a design objective of many different types of irrigation devices. That objective has become increasingly important due to concerns and regulation at the federal, state and local levels of government regarding the efficient usage of water. Over time, irrigation devices have become more efficient at using water in response to these concerns and regulations. However, there is an ever-increasing need for efficiency as demand for water increases.

As typical irrigation sprinkler devices project streams or sprays of water from a central location, there is inherently a variance in the amount of water that is projected to areas around the location of the device. For example, there may be a greater amount of water deposited further from the device than closer to the device. This can be disadvantageous because it means that some of the area to be watered will be over watered and some of the area to be watered will receive the desired about of water or, conversely, some of the area to be watered will receive the desired amount of water and some will receive less than the desired about of water. In other words, the distribution of water from a single device is often not uniform.

Two factors contribute to efficient irrigation: (1) a relatively low precipitation rate to avoid the use of too much water; and (2) relatively uniform water distribution so that different parts of the terrain are not overwatered or underwatered. The precipitation rate generally refers to the amount of water used over time and is frequently measured in inches per hour. It is desirable to minimize the amount of water being distributed in combination with sufficiently and uniformly irrigating the entire terrain.

Some conventional nozzles use a number of components that are molded separately and are then assembled together. For example, U.S. Pat. No. 5,642,861 is an example of a fixed arc nozzle having a separately molded nozzle base for mounting the nozzle to a fluid source, base ring, and deflector for directing the fluid outwardly from the nozzle. Other nozzles are complex and have a relatively large number of parts. For example, U.S. Pat. No. 9,776,195 discloses a nozzle that uses a number of inserts and plugs installed within ports. As an alternative, it would be desirable to have a nozzle having a simple one-piece, molded nozzle body that may reduce the costs of manufacture.

Accordingly, a need exists for a nozzle that provides efficient irrigation by combining a relatively low precipitation rate with uniform water distribution. Further, many conventional nozzles include a number of components, such as a nozzle base, nozzle collar, deflector, etc., which are often separately molded and are then assembled to form the nozzle. It would be desirable to reduce the cost and complexity of nozzles by reducing the number of separately molded components. It would be desirable to be able to form a one-piece, molded nozzle body that would avoid the need for separate component molds and the need for assembly after component molding.

Further, it has been found that irrigation may be especially non-uniform at the boundary edges of an irrigation pattern. More specifically, an excessive amount of fluid may be concentrated at these boundary edges, and a nozzle may distribute fluid either too far or not far enough along these boundary edges. Accordingly, there is a need to improve the irrigation uniformity at the boundary edges relative to other portions of the irrigation pattern.

DESCRIPTION OF THE PREFERRED EMBODIMENTS

Figure 1:
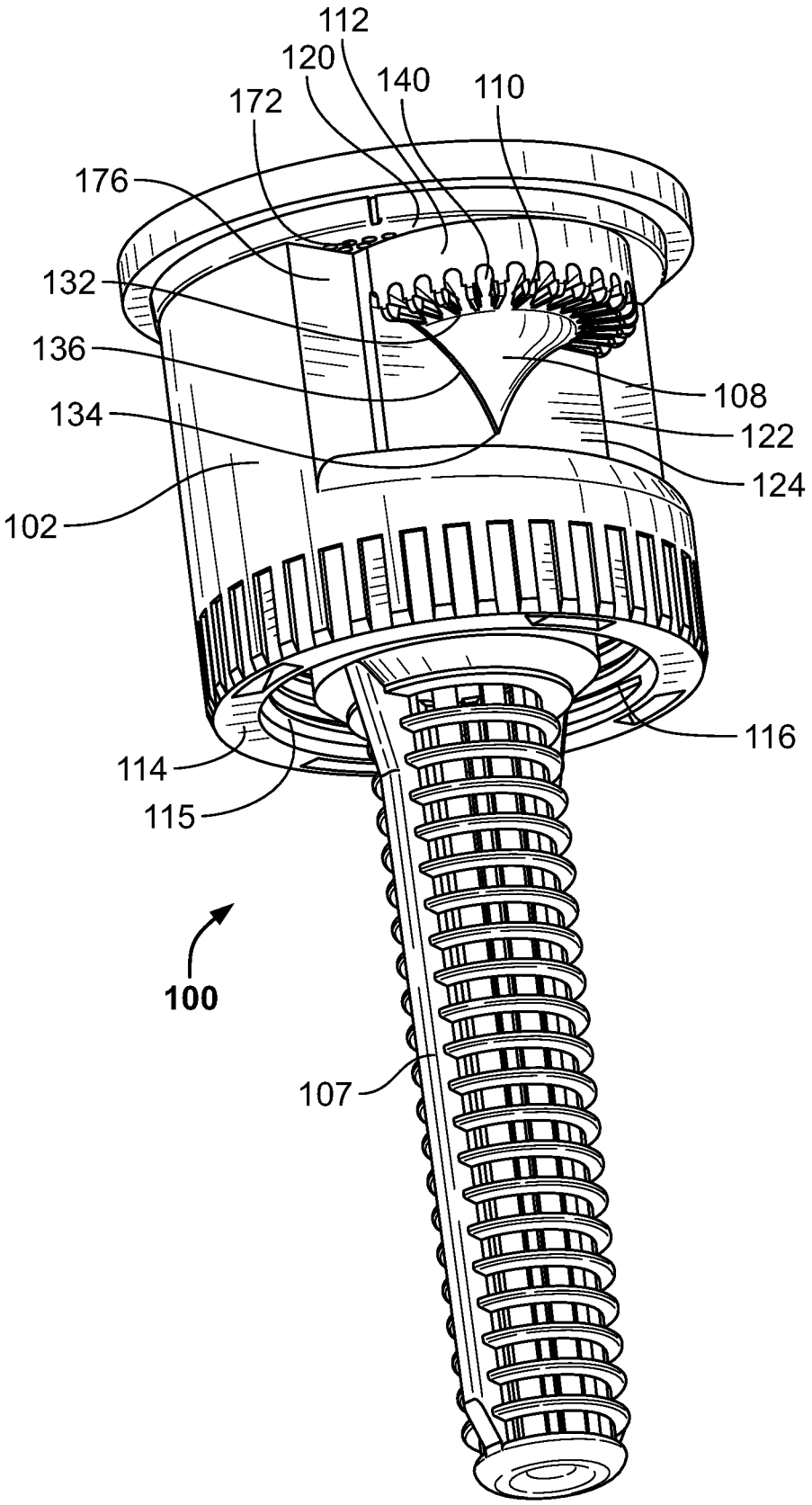
FIG. 1 is a bottom perspective view of an embodiment of a nozzle embodying features of the present invention.

In one form, the exemplary drawings show a nozzle 100 that improves efficiency of irrigation by combining a relatively low precipitation rate with relatively uniform fluid distribution. The nozzle 100 includes a small inflow port 106 (or central channel) to allow a relatively small volume of water through the nozzle 100, i.e., to provide a low precipitation rate. The spray nozzle 100 further includes a deflector 112 with a profile including rib structures forming different types of flow channels that separate fluid into different streams in order to improve the overall water distribution, i.e., to provide relatively uniform fluid distribution. Many conventional irrigation nozzles have deflectors with a series of similarly shaped radial flutes that distribute one type of fluid spray. In contrast, the deflectors of the preferred embodiments have a series of ribs with structures disposed in the flow paths of the fluid resulting in different streams having different characteristics. The different sprays combine to provide a relatively uniform water distribution pattern.

As described further below, the nozzle 100 preferably includes one or more of the following features to improve uniformity of fluid in the irrigation pattern: (1) vent holes to normalize air pressure behind the water streams emerging from the nozzle 100 to facilitate uniform fluid distribution at the boundary edges of the irrigation pattern; (2) a rear wall offset a certain distance to facilitate uniform fluid distribution at the boundary edges of the irrigation pattern; and (3) a port aperture with a cross-section defining a complex geometry of compound radii to improve distribution uniformity. The vent holes and the rear wall offset help reduce heavy precipitation along the boundary edge of the irrigation pattern and help reduce overthrow beyond the intended throw radius. The geometry of the port aperture helps decrease precipitation at the boundary edges and achieve uniform distribution throughout the irrigation pattern.

One embodiment of a nozzle 100 is shown in FIGS. 1-8. In this form, the nozzle 100 generally comprises a compact unit, preferably made primarily of lightweight molded plastic, which is adapted for convenient thread-on mounting onto the upper end of a stationary or pop-up riser (not shown). The nozzle 100 preferably includes a one-piece nozzle body 102 and a flow throttling screw 104. In operation, fluid under pressure is delivered through the riser to the nozzle body 102. The fluid preferably passes through an inflow port 106 controlled by the throttling screw 104 that regulates the amount of fluid flow through the nozzle body 102. The nozzle 100 also preferably includes a filter 107 to screen out particulate matter upstream of the inflow port 106. Fluid is directed generally upwardly through the inflow port 106, along a generally conical transition surface 108, and then along ribs 110 formed in the underside surface of a deflector 112.

As can be seen, the nozzle body 102 is preferably generally cylindrical in shape. It includes a bottom mounting end 114 forming an inlet 115 and with internal threading 116 for mounting of the nozzle body 102 to corresponding external threading on an end of piping, such as a riser, supplying water. The nozzle body 102 also defines a central bore 118 to receive the flow throttling screw 104 to provide for adjustment of the inflow of water into the nozzle body 102. Threading may be provided at the central bore 118 to cooperate with threading on the screw 104 to enable movement of the screw 104. The nozzle body 102 also preferably includes a top deflecting end defining a distal wall 120 relative to the inlet 115 and defining the underside surface of the deflector 112 for deflecting fluid radially outward through a fixed, predetermined arcuate span. Further, the nozzle body 102 includes a recess 122 defined, in part, by a boundary wall 124 and with the conical transition surface 108 disposed within the recess 122.

Figure 2:
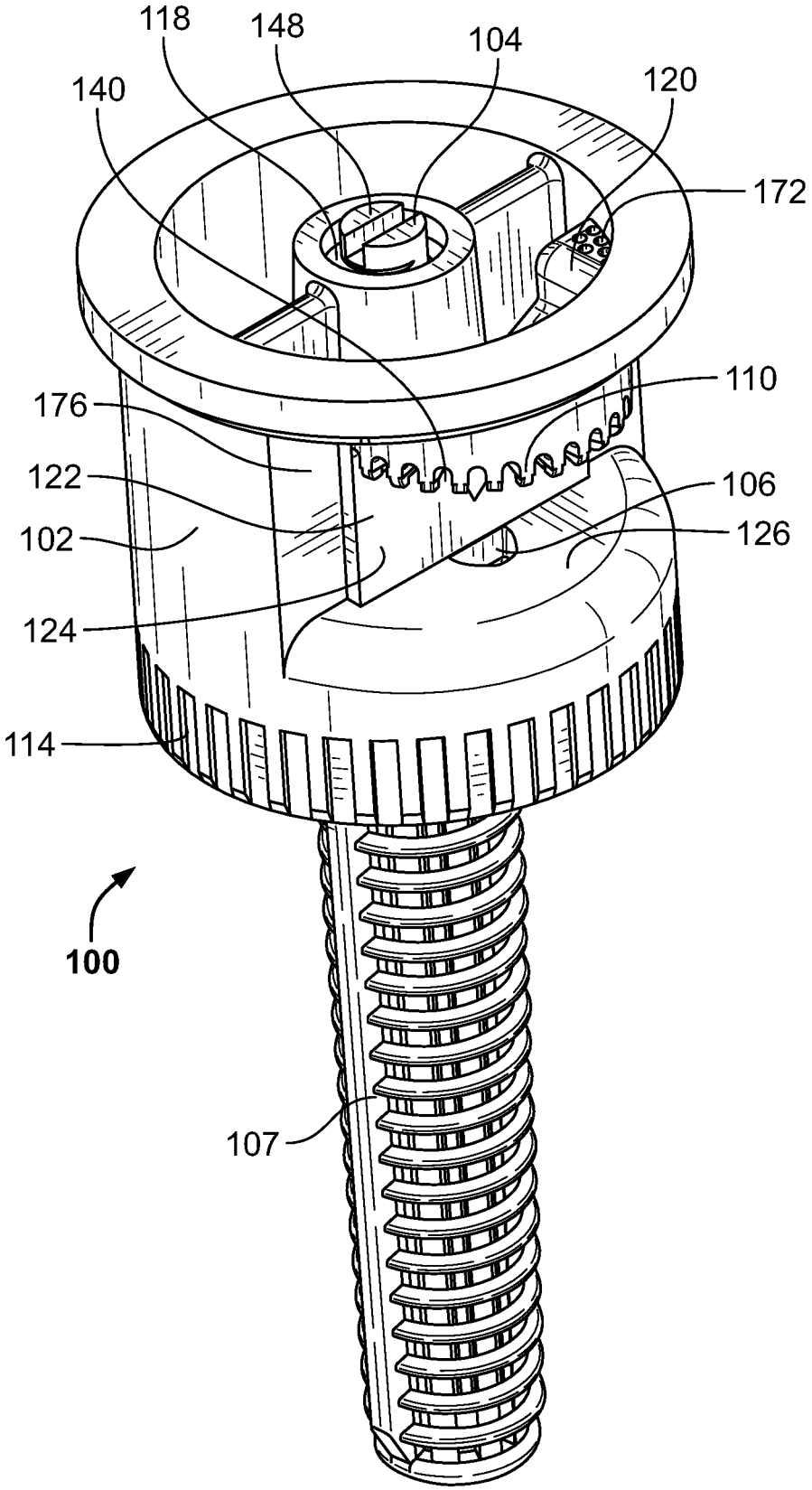
FIG. 2 is a top perspective view of the nozzle of FIG. 1.
Figure 3:
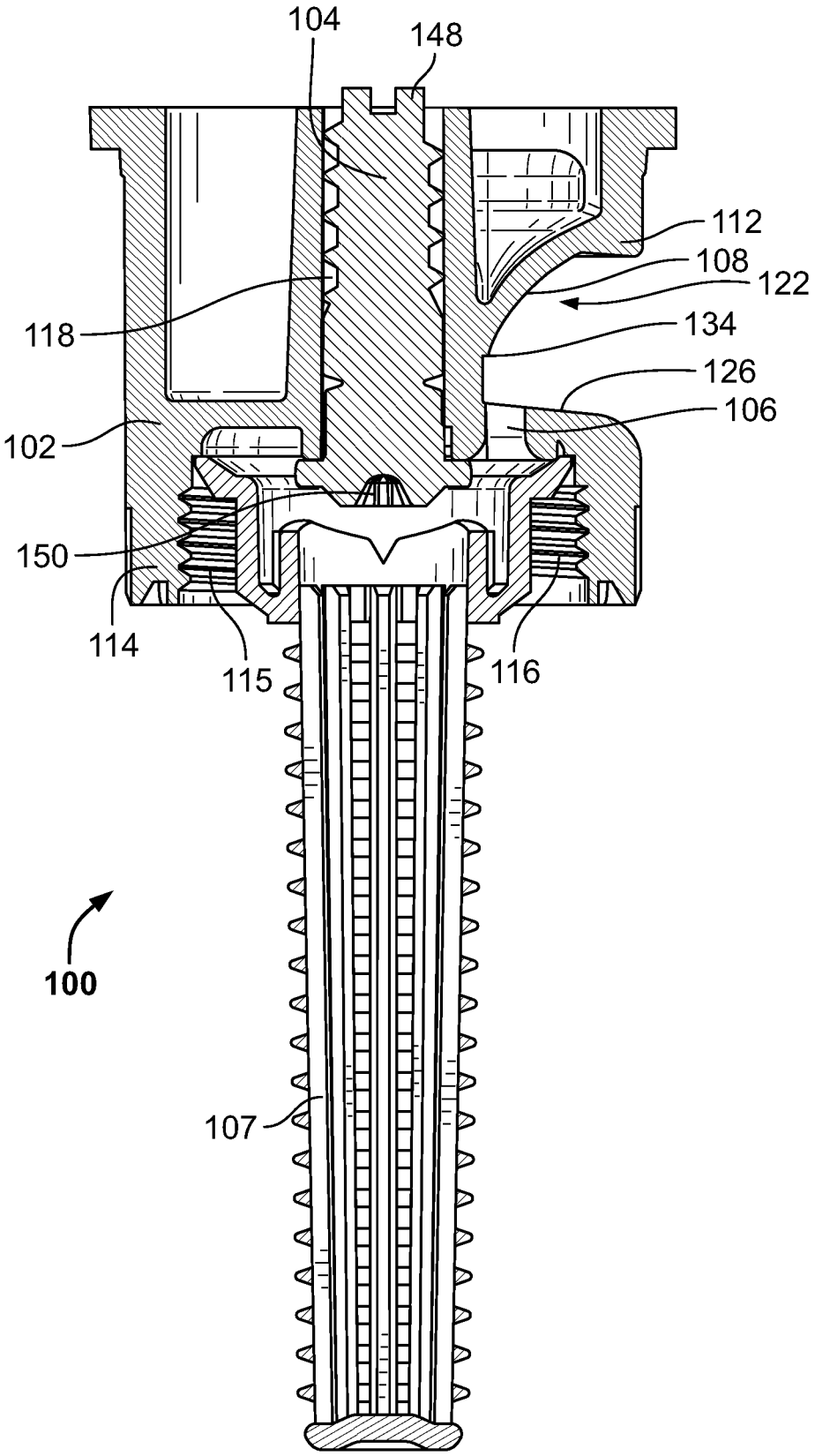
FIG. 3 is a cross-sectional view of the nozzle of FIG. 1.
Figure 4:
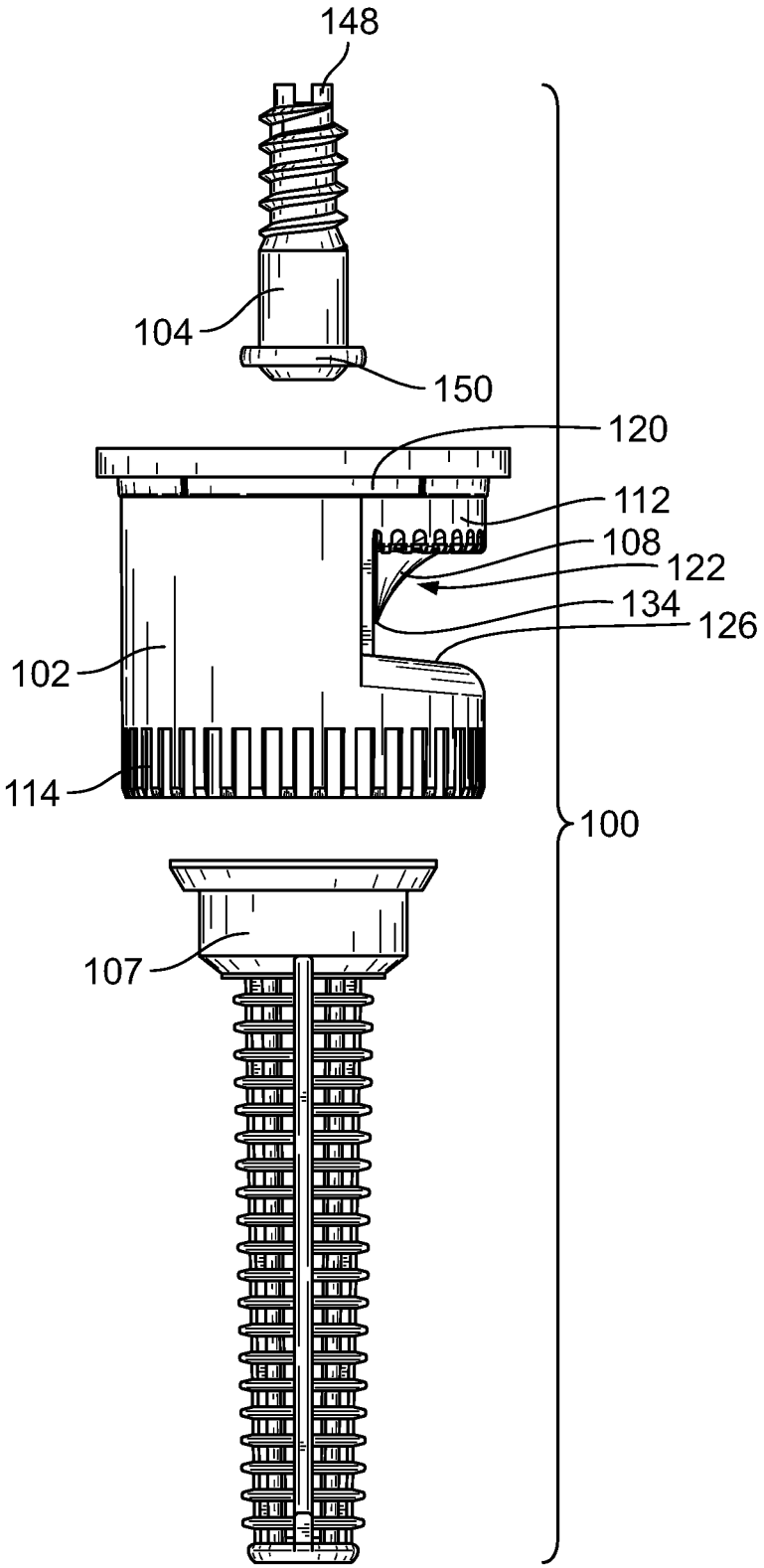
FIG. 4 is an exploded view of the nozzle of FIG. 1.
Figure 5:
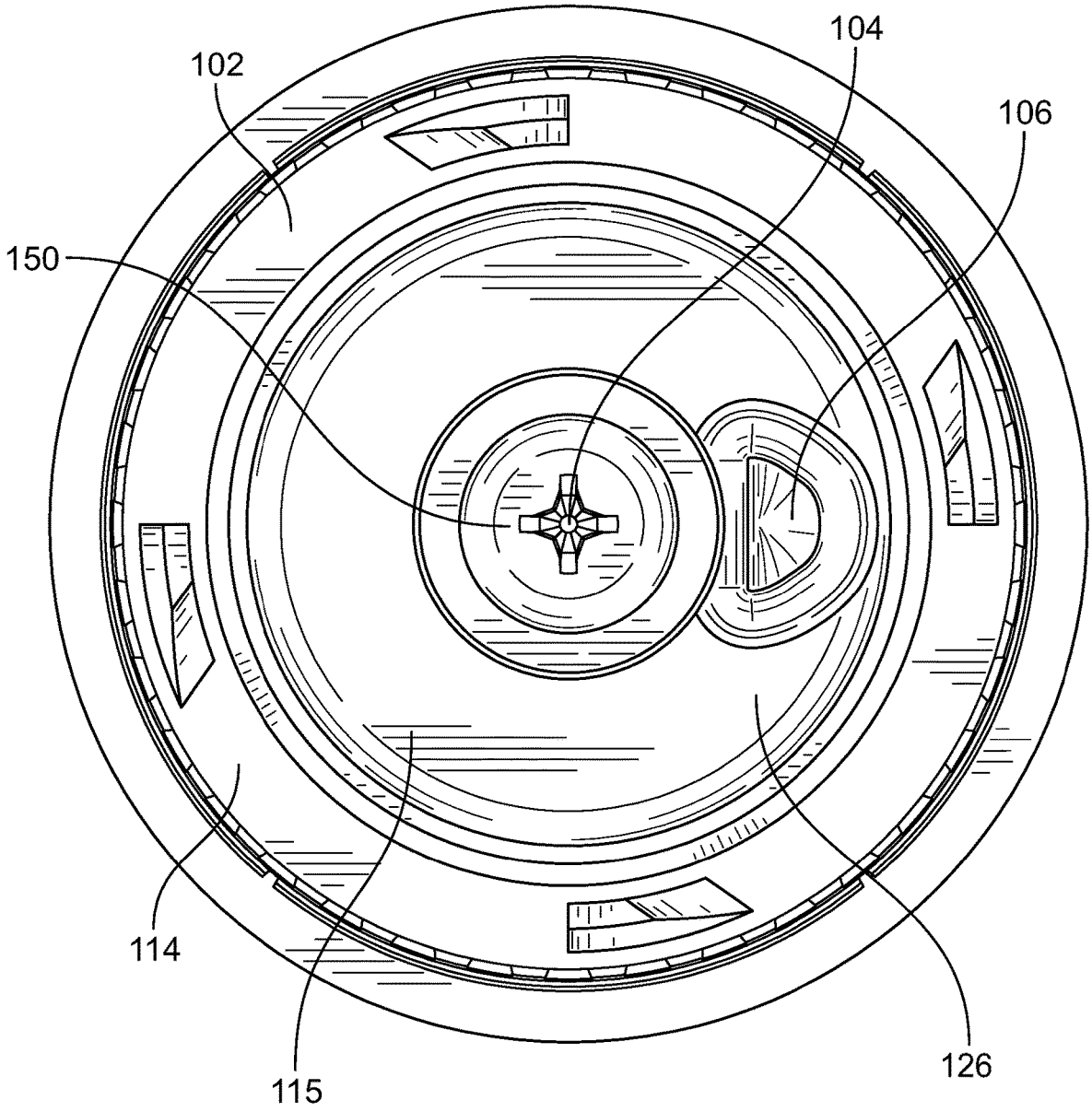
FIG. 5 is a bottom plan view of the nozzle of FIG. 1 (with the filter removed)

As can be seen in FIGS. 1 and 2, for the half-circle nozzle 100, the inflow port 106 generally extends about 180 degrees in order to cover a 180 degree irrigation pattern. The inflow port 106 is preferably disposed in a plate 126 located downstream of the internal threading 116 and is preferably located adjacent the central bore 118 that receives the throttling screw 104. Although in this embodiment the threading is shown as internal threading 116, it should be evident that the threading may be external threading instead. Some risers or fluid source are equipped with internal threading at their upper end for the mounting of nozzles. In this instance, the nozzle may be formed with external threading for mounting to this internal threading of the riser or fluid source.

Figure 10:
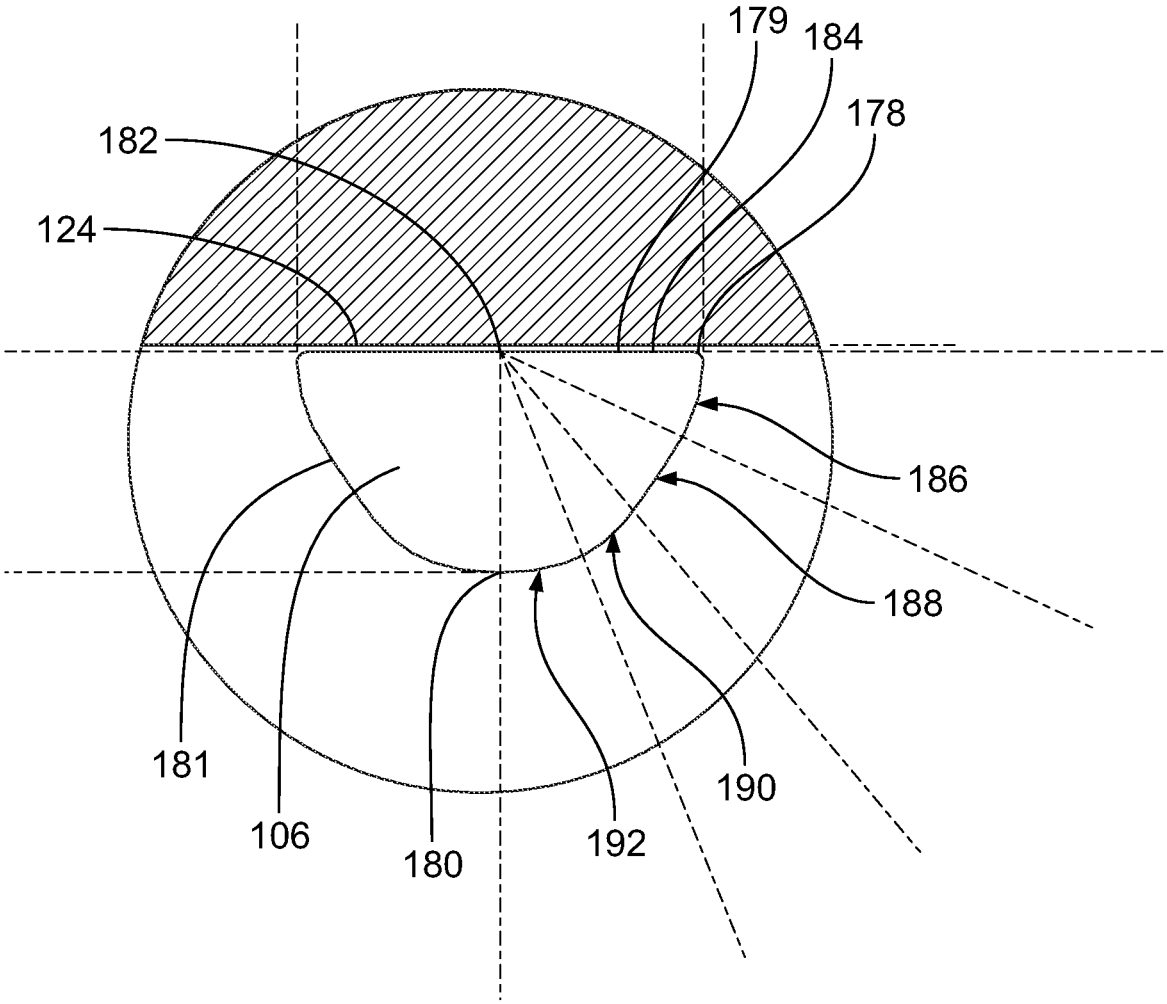
FIG. 10 is a schematic representation of the port of the nozzle of FIG. 1 showing the geometry of the port.

The cross-section of the inflow port 106 may be modified in different models to match the precipitation rate. In one preferred form, for example, the cross-section of the inflow port 106 may be configured for a maximum throw of 8 feet with a low precipitation rate that is less than 1 inch per hour, preferably about 0.9 inches per hour. The cross-section of the inflow port 106 may be increased for nozzles intended to have a longer maximum throw radius (such as, for example, 15 feet) while maintaining the matched precipitation rate of about 0.9 inches per hour. As should be evident, the dimensions of inflow ports of other models may be configured for different intended throw distances while preferably matching this precipitation rate. In one straightforward example, the cross-section of the port may be in the shape of a regular semi-circle. However, in another form, the cross-section of the port 106 extends 180 degrees but is preferably defined by compound radii, as shown in FIG. 10 and as addressed further below.

Further, as addressed below, the shape of the inflow port 106 may be modified to achieve different fixed arcuate spans. For example, the cross-section of the inflow port may extend 90 degrees for quarter-circle (or 90 degree) irrigation, or two opposing 180 degree inflow ports may be used to achieve close to full circle (or 360 degree) irrigation. Alternatively, two inflow ports (one extending 180 degrees and the other extending 90 degrees) may be used to achieve roughly three-quarter circle (or 270 degree) irrigation, or two inflow ports of approximately the same size may be formed to achieve this three-quarter circle irrigation. Again, these models with different arcuate spans would preferably have matched precipitation rates of about 0.9 inches per hour.

As can be seen in FIGS. 1 and 2, once fluid flows through the inflow port 106, it then flows along the conical transition surface 108 to a water distribution profile on the underside of the deflector 112. The transition surface 108 is intermediate of the port 106 and the profile, which includes a plurality of ribs 110, and guides flow directed through the port 106 to the flutes 140 defined by successive ribs 110. The transition surface 108 is aligned with and expands smoothly outwardly in the direction of the plurality of ribs 110 and reduces energy loss experienced by fluid flowing from the port 106 to the flutes 140. The transition surface 108 is generally conical in shape having a vertex 134 disposed near the port 106 expanding into smoothly curved sides 136 having increasing curvature in the direction of the deflector 112 and terminating in a base 132 near the plurality of ribs 110. For the half-circle nozzle 100, the conical transition surface 108 is preferably in the shape of an inverted half-cone with a generally semi-circular base 132 on the underside of the deflector 112 and a vertex 134 offset slightly from the boundary wall 124. The conical transition surface 108 is preferably curved to smoothly guide upwardly directed fluid radially and outwardly away from the central axis of the nozzle body 102 to the ribbed deflector surface. The portion of the cone near the vertex 134 is preferably inclined closer to vertical with less curvature, and the portion of the cone near the base 132 preferably has greater curvature. Various different forms of curvature may be used for the conical transition surface 108, including catenary and parabolic curvature. Also, as should be evident, the surface 108 need not be precisely conical.

The dimensions of the conical transition surface may be modified in different models to provide different flow characteristics. For example, the vertex may be located at different vertical positions along the boundary wall, the semi-circular base may be chosen with different diameters, and the curved edge surface may be chosen to provide different degrees of curvature. These dimensions are preferably chosen to provide a more abrupt transition for shorter maximum throw radiuses and a gentler transition for longer maximum throw radiuses. For instance, for an 8-foot nozzle (in comparison to the 15-foot nozzle 100), the vertex 134 may be located higher along the boundary wall 124, the semi-circular base 132 may be smaller, and the curved edge surface 136 may have less curvature. Thus, for an 8-foot nozzle, the upwardly directed fluid strikes the underside surface of the deflector 112 more squarely, which dissipates more energy and results in a shorter maximum throw radius than the 15-foot nozzle 100.

Further, as with the inflow port 106, the shape of the conical transition surface 108 may be modified to accommodate different fixed arcuate spans, as addressed further below. For example, the conical transition surface may be in the shape of an inverted quarter conical portion with a vertex and a quarter-circle base for quarter-circle (or 90 degree) irrigation. Alternatively, the nozzle body may include two inverted half-conical portions facing opposite one another to achieve close to full circle (or 360 degree) irrigation. Further, the nozzle body may include one inverted half-conical portion and one inverted quarter-conical portion facing opposite one another for three-quarter circle (or 270 degree) irrigation, or the nozzle body may include two conical portions of approximately the same size for this three-quarter circle irrigation.

As shown in FIGS. 1 and 2, the deflector 112 is generally semi-cylindrical. The deflector 112 has an underside surface that is contoured to deliver a plurality of fluid streams generally radially outwardly therefrom through a predetermined arcuate span. In the half-circle nozzle 100, the arcuate span is preferably about 180 degrees, although other predetermined arcuate spans are available. As shown in FIGS. 1, 2, 7, and 8, the underside surface of the deflector 112 preferably defines a water distribution profile that includes an array of ribs 110. The ribs 110 subdivide the water into multiple flow channels for a plurality of water streams that are distributed radially outwardly therefrom to surrounding terrain. As addressed further below, the ribs 110 form flow channels that provide different trajectories with different elevations for the water streams. These different trajectories allow water distribution to terrain relatively close to the nozzle 100 and to terrain relatively distant from the nozzle 100, thereby improving uniformity of water distribution.

Figure 6:
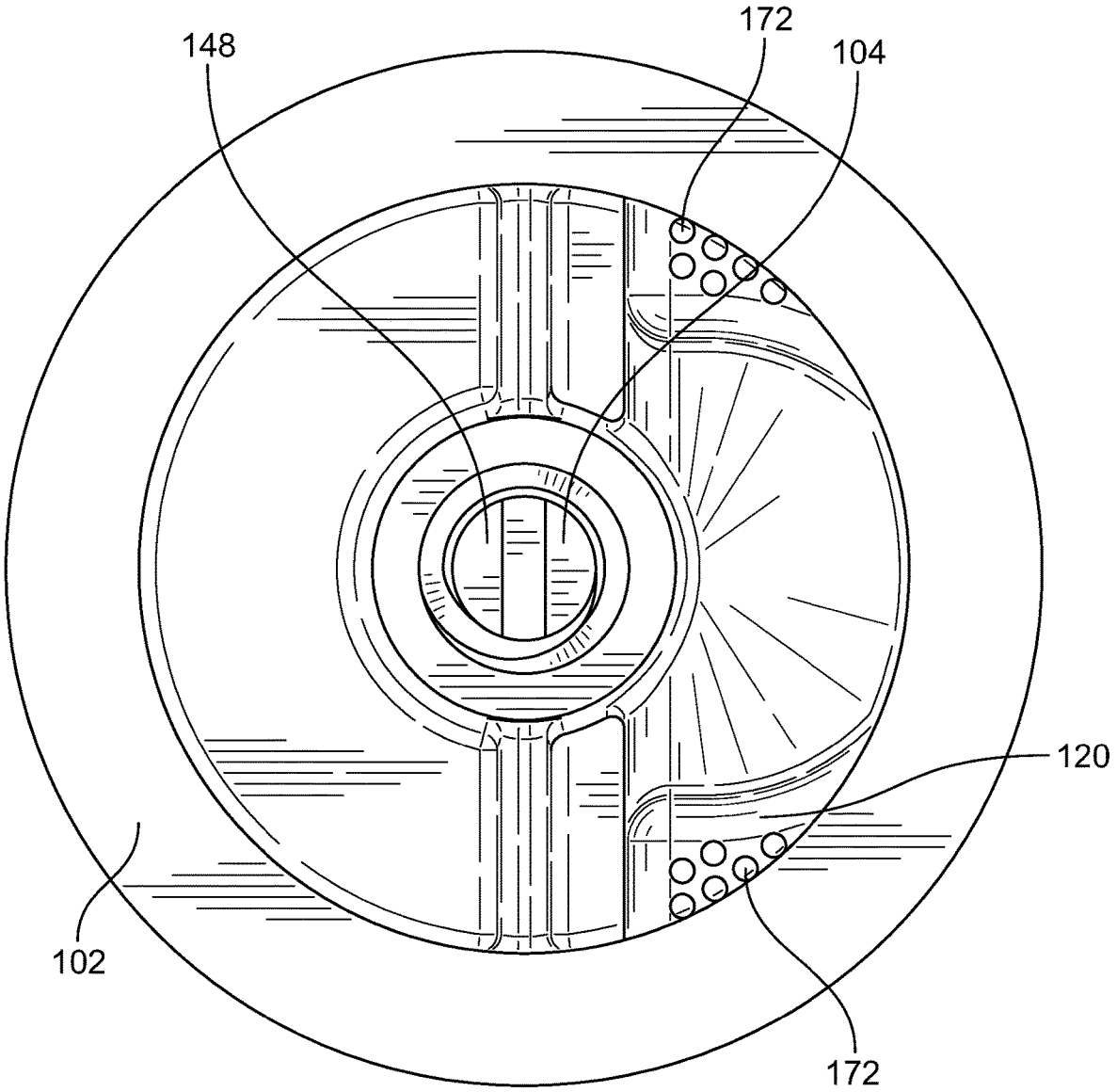
FIG. 6 is a top plan view of the nozzle of FIG. 1.
Figure 7:
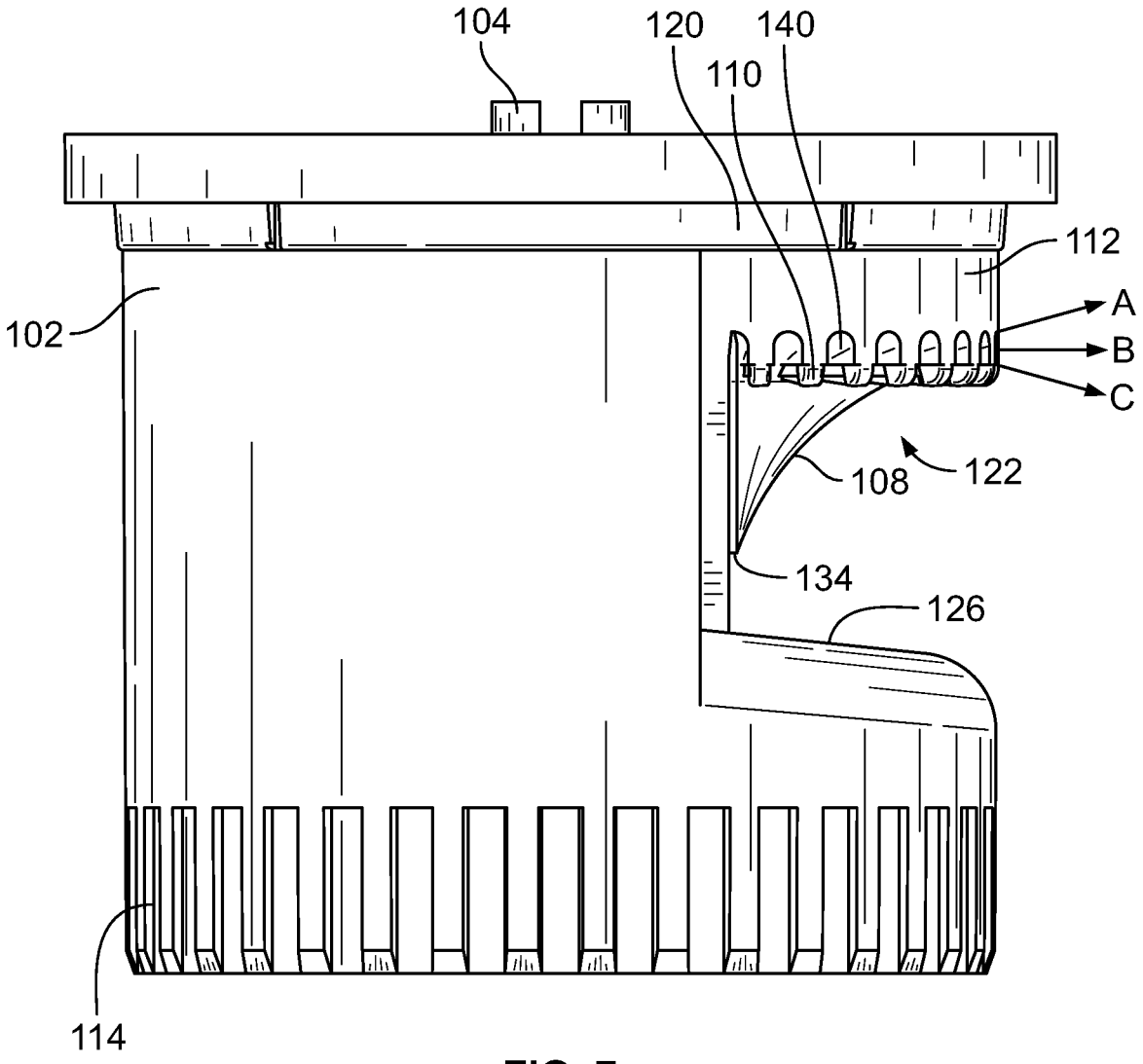
FIG. 7 is a side elevational view of the nozzle of FIG. 1 (with the filter removed)

In view of this deflector configuration, the nozzle 100 shown in FIGS. 1-8 is a multi-stream, multi-trajectory nozzle. As can be seen in FIG. 7, the deflector 112 is contoured to create flow channels for water streams having at least three different types of trajectories: (1) a distant trajectory with a relatively high elevation (A); (2) an intermediate trajectory with an intermediate elevation (B); and (3) a close-in trajectory with a relatively low elevation (C). These three different water trajectories allow coverage of terrain at different distances from the nozzle 100 and thereby provide relatively uniform coverage.

A variety of different rib configurations are possible. In one form, as shown in FIGS. 1, 2, 7, and 8, the deflector 112 includes a plurality of radially-extending ribs 110 that form part of its underside. Flutes 140 for water are formed between adjacent ribs 110 and have rounded bottoms 162 coinciding with the underside of the upper deflector surface 158. The ribs 110 are each configured to divide the fluid flow through the flutes 140 into different channels for different sprays directed to different areas and thereby having different characteristics. A similar rib structure is described in U.S. Pat. No. 9,314,952, which description is incorporated herein by reference in its entirety.

Figure 8:
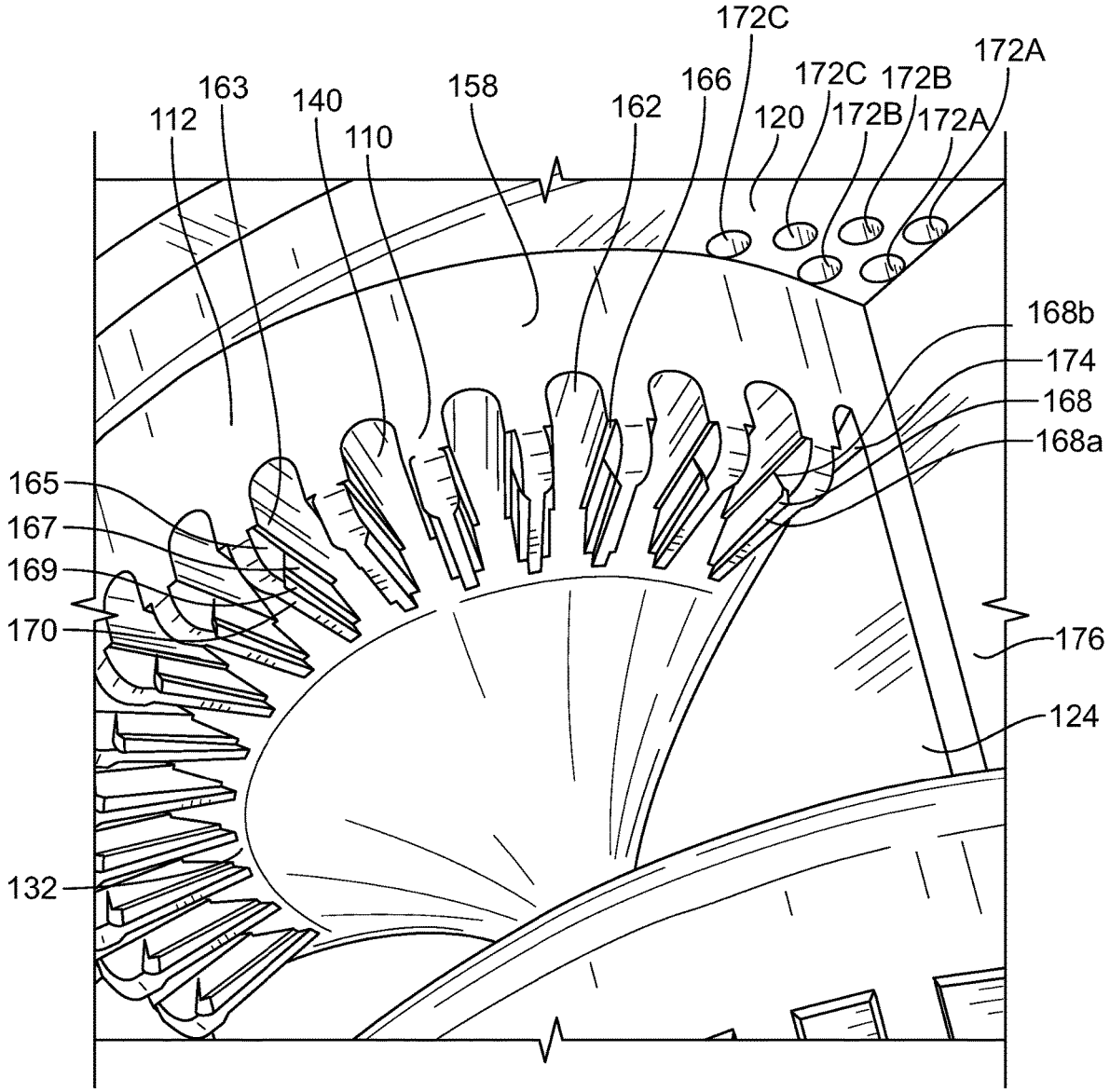
FIGS. 8 and 9 are detailed perspective views of some of the ribs on the underside of the deflector portion of the nozzle of FIG. 1.
Figure 9:
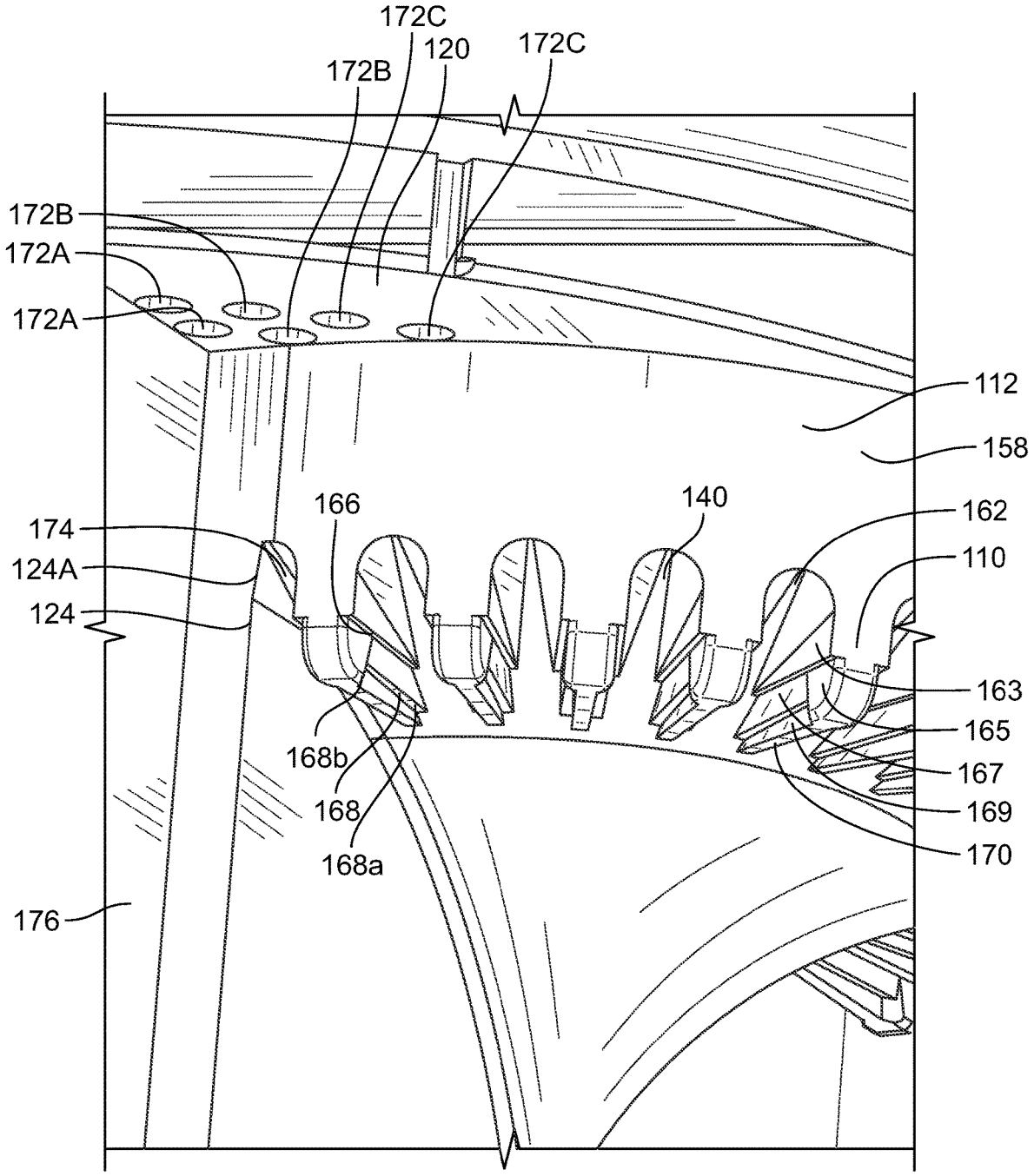

As the ribs 110 are each generally symmetric about a radially-extending line, only one of the sides of a representative rib 110 will be described with it being understood that the opposite side of that same rib 110 has the same structure. With reference to FIGS. 8 and 9, the rib 110 has a first step 166 forming in part a first micro-ramp and a second step 168 defining in part a second micro-ramp. The first step 166 is generally linear and positioned at an angle closer to perpendicular relative to a central axis of the deflector 112 as compared to the bottom 162 of the upper deflector surface 158, as shown in FIGS. 8 and 9. The second step 168 is segmented, having an inner portion **168*a* that extends closer to perpendicular relative to the central axis as compared to an outer portion 168*b***, which has a sharp downward angle.

The geometries of the ribs 110 and the bottom 162 of the of the upper deflector surface 158 cooperate to define a plurality of micro-ramps which divide the discharging water into sprays having differing characteristics. More specifically, the first and second steps 166 and 168 divide the sidewall into four portions having different thicknesses: a first sidewall portion 163 disposed beneath an outward region of the bottom 162 of the upper deflector surface 158; a second sidewall portion 165 disposed beneath the first sidewall portion 163 and at the outer end of rib 110; a third sidewall portion 167 disposed beneath the first sidewall portion and radially inward from the second sidewall portion 167, and a fourth sidewall portion 169 disposed beneath the first and second sidewall portions 165 and 167, as depicted in FIGS. 8 and 9. As addressed further below, these four sidewall portions result in fluid flow along the ribs 110 in multiple water streams that combine to provide relatively uniform fluid distribution.

In this form, the half-circle nozzle 100 preferably includes 15 ribs 110. These ribs 110 produce water streams in three sets of general flow channels having general trajectories for relatively distant, intermediate, and short ranges of coverage. More specifically, and with reference to FIG. 7, there is a distant spray A, a mid-range spray B, and a close-in spray C. However, rather than being distinct trajectories, these secondary and tertiary streams (B and C) are deflected or diffused from the sides of the relatively distant, nominal streams (A). Accordingly, this type of nozzle 100 is a multi-stream, multi-diffuser nozzle. Of course, the number of streams may be modified by changing the number of ribs 110.

The flow channels for the relatively distant streams (A) are formed primarily by the uppermost portion of the flutes 140 between successive ribs 110. More specifically, these streams (A) flow within the uppermost portion of the flute 140 defined by the rounded bottoms 162 at the underside of the upper deflector surface 158 and extending downwardly to the first steps 166. As can be seen in FIGS. 8 and 9, this uppermost portion is generally curved near the base of the flute 140, such as in the shape of an arch. There is one stream (A) between each pair of ribs 110 and between the two edge ribs 110 and the boundary wall 124.

The flow channel for the mid-range spray (B) is defined generally by the side of each rib 110 between the first step 166 and the second step inner portion **168*a*. More specifically, these streams (B) flow within an intermediate portion of the discharge channel 140 and have a lower general trajectory than the distant streams (A). These mid-range streams (B) may be deflected laterally to some extent by the second step outer portion 168*b*. There is one stream (B) corresponding to the side of each rib 110**.

The flow channels for the close-in streams (C) are formed generally by the lowermost portion of the flute 140 on each side of rib 110. More specifically, these streams (C) flow beneath the second step 168 and along the lowermost portions of the ribs 110. These streams (C) generally have a lower trajectory than the other two streams (A and B) and impact and are directed downwardly by the second step outer portion **168*b*. The sharply inclined end segment 168*b* is configured to direct the water spray more downwardly as compared to the spray from the first micro-ramp. There is one stream (C) corresponding to the side of each rib 110**.

As addressed above, these three general trajectories are not completely distinct trajectories. The relatively distant water stream (A) has the highest trajectory and elevation, generally does not experience interfering water streams, and therefore is distributed furthest from the nozzle 100. However, the secondary and tertiary streams (B and C) are deflected or diffused from the sides of the ribs 110, have lower general trajectories and elevations, and experience more interfering water streams. As a result, these streams (B and C) fill in the remaining pattern at intermediate and close-in ranges.

The positioning and orientation of the first and second steps 166 and 168 may be modified to change the flow characteristics. It will be understood that the geometries, angles and extent of the micro-ramps can be altered to tailor the resultant combined spray pattern. Further, in some circumstances, it may be preferable to have less than all of the ribs 110 include micro-ramps. For instance, the micro-ramps may be on only one side of each of the ribs 110, may be in alternating patterns, or in some other arrangement.

In the exemplary embodiment of a nozzle 100, the ribs 110 are spaced at about 10 degrees to about 12 degrees apart. The first step 166 is preferably triangular in shape and between about 0.004 and 0.008 inches in width at its outer end from the sidewall of the adjacent portion of the rib 110, such as about 0.006 inches. It preferably has a length of about 0.080 inches and tapers downwardly about 6 degrees from a horizontal plane defined by the top of the nozzle 100. The second step 168 may be between about 0.002 inches in width, an inner portion 168*a* may be about 0.05 inches in length, and an angle of the inner portion 168*a* may be about 2 degree relative to a horizontal plane. The angle of the bottom portion 170 of rib 110 may be about 9 degrees downwardly away from a horizontal plane coinciding with the top of the nozzle 100. While these dimensions are representative of the exemplary embodiment, they are not to be limiting, as different objectives can require variations in these dimensions, the addition or subtraction of the steps and/or micro-ramps, and other changes to the geometry to tailor the resultant spray pattern to a given objective.

Other rib features and configurations are described in U.S. Pat. No. 9,314,952, which description is incorporated herein by reference in its entirety. The rib features and configurations disclosed in U.S. Pat. No. 9,314,952 may be incorporated into the nozzle embodiments disclosed in this application. More specifically, the deflector surface and water distribution profile including rib features of that application may be used in conjunction with the inflow ports, conical transition surfaces, and other parts of the nozzle embodiments disclosed above.

As can be seen from FIGS. 6, 8, and 9, the nozzle 100 also includes features to increase the uniformity of distribution at the boundary edges, i.e., at each 180 degree boundary edge. The nozzle 100 includes vent holes 172 to normalize air pressure behind the water streams emerging from the nozzle 100. These vent holes 172 preferably extend vertically through the distal wall 120. They are generally disposed at two positions at each arcuate end of the deflector, these two positions corresponding to each boundary flute 174 defining each of the two boundary edges of the irrigation pattern. In this preferred form, there are six vent holes 172 disposed about each boundary flute 174. More specifically, as can be seen, in this preferred form, two of the vent holes 172A are disposed behind the boundary flute 174 (adjacent the rear wall 176), two of the vent holes 172B are disposed above the boundary flute 174 (vertically above the water stream exiting this flute 174), and vent holes 172C are disposed in front of the boundary flute 174 (vertically above the rib 110 and flute 140 adjacent the boundary flute 174). It is believed that the positioning of the two vent holes 172A between streams exiting the boundary flutes 174 and the rear wall 176 provide air flow that help produce crisp boundary edges, regardless of the pressure of the exiting water streams. The vent hole pattern may only include one or more holes 172A. Further, as can be seen, the boundary flute 174 is not the same size as the other flutes 140 but is instead about half of the diameter of the other flutes 140.

It is believed that, without vent holes 172A, fluid distributed at the boundary edges will tend to cling to the boundary wall 124 and/or the rear wall 176. In other words, when this fluid exits at the boundary edges, it tends to wrap around the corners and adhere to one or both walls 124, 176. When fluid is exiting the vent holes 172A, air is generally drawn downward into the space between the exiting water stream and the rear wall 176. By normalizing the air pressure behind the exiting water stream, a more uniform irrigation pattern is formed. This result is generally true regardless of the fluid pressure, fluid flow, and fluid velocity. It is believed that, without vent holes 172A, low flow and low velocity conditions may especially result in non-uniform and uneven irrigation patterns.

As should be understood, the number and arrangement of vent holes 172 may be modified. It is generally believed that several vent holes 172 may be desirable for redundancy to make the vent holes 172 more grit resistant. Further, the vent holes 172 may define any of various cross-sectional shapes, including circular, oval, rectangular, triangular, etc. It is believed that the two vent holes 172A closest to the rear wall 176 may provide the most benefit, and they may prevent impact with and/or clinging to the rear wall 176. It is also believed that some or all of the vent holes 172 help prevent impact of the exiting water streams with the distal wall 120.

As mentioned above, and as can be seen in FIGS. 1, 2, 7, 8, and 9, the two boundary flutes 174 are half flutes, i.e., they each have about half of the cross-section of the other flutes of the deflector 112. It is believed that boundary flutes 174 of the same size as the other flutes results in too much water at the boundary edges of the irrigation pattern, and it is believed that the water streams at the boundary edges tends to draw in more water. These two truncated flutes 174 therefore reduce the amount of water at the boundary edges of the pattern.

Further, in one form, the rear wall 176 may be preferably offset from the boundary wall 124 by a minimum distance of about 0.010 to 0.015 inches. This minimum offset helps limit the water streams deflecting off of the rear wall 176 and reduce the amount of friction resulting from the rear wall 176. As stated, such water streams impacting or adhering to the rear wall tend to contribute to heavy precipitation along the boundary edges of the irrigation pattern and/or contribute to overthrow beyond the intended throw radius. It is believed that the offset must have a minimum distance to provide a certain amount of separation to allow air to flow into the space between the exiting water stream and the rear wall 176. However, too much offset may lead to a decrease in performance because it may lead to air flow in the wrong direction, i.e., not primarily downward but also including some lateral components.

In addition, the cross-section of the port 106 is preferably shaped in a certain manner to increase the uniformity of the entire irrigation pattern. More specifically, the port 106 is preferably formed of a complex geometry of arc segments with different/compound radii to improve distribution uniformity. In other words, the port 106 extends about 180 degrees but is not precisely semi-circular in cross-section. The lateral edges (the left and right sides) of the port 106 are preferably symmetrical, and each lateral edge preferably defines a shorter leg/radius relative to a longer leg/radius relative to the forward edge. As stated above, fluid tends to accumulate and overthrow at the boundary edges, resulting in a less uniform pattern. By adjusting the shape of the port 106 in this manner, less fluid is directed to the boundary edges of the irrigation pattern and more fluid is directed to the forward portion of the irrigation pattern. In one straightforward example, the port 106 may be formed of arc segments with two distinct radii: a shorter radius to the lateral edges and a longer radius to the forward edge.

An exemplary form of a port 106 with more compound radii, e.g., four compound radii, is shown in FIG. 10. As can be seen, in this form, the lateral edge points 178 of the port 106 define sides 179 having shorter legs than the center 180 of the forward edge 181. More specifically, in this particular example, the shorter legs are preferably about 0.058 inches from the midpoint 182 of the base 184, and the longer leg to the center 180 of the forward edge 181 is about 0.063 inches (although it should be understood that other dimensions are possible). In this form, the cross-sectional shape of the port 106 includes a base 184 with a midpoint 182, two lateral edge points 178 disposed at equal distances from the midpoint 182, and a forward edge 181 spaced from the midpoint 182 and connecting the two lateral edge points 178. Further, in this form, the distance from the midpoint 182 to each lateral edge point 178 is less than the distance from the midpoint 182 to the center 180 of the forward edge 181.

Additional radii have been added to fine tune fluid distribution within the irrigation pattern. More specifically, as can be seen, in this particular form, the cross-section of the port 106 is defined by arcuate segments having four different radiuses/curvatures. In this particular example, starting from one lateral edge point 178, the first arcuate segment 186 preferably has a radius of about 0.045 inches and extends about 25 degrees; the second arcuate segment 188 preferably has a radius of about 0.713 inches and also extends about 25 degrees; the third arcuate segment 190 has a radius of about 0.040 inches and extends about 18 degrees; and the fourth arcuate segment 192 has a radius of about 0.072 inches and extends about 22 degrees. As can be seen, in this form, the port 106 generally has a bulging forward portion so as to fill in forward portions of the irrigation pattern, i.e., the port 106 is oblong in cross-sectional shape in the forward direction. The dimensions and shape of the port 106 may be scaled and adjusted, as desired, to fill in various sizes and shapes of irrigation patterns.

In this form, the cross-section of the port 106 is symmetrical about the line from the midpoint 182 to the center 180 of the forward edge 181. In addition, in this form, the cross-section of the port 106 is preferably offset slightly from the boundary wall 124. In other words, the base 184 of the port 106 is spaced slightly from the boundary wall 124, and in one form, it may be spaced about 0.002 inches from the boundary wall 124.

As should be understood, other arrangements of the number, curvature, and extent of arcuate segments are possible. For example, and without limitation, there may be three, five, or more arcuate segments with any of various arcuate curvatures and that extend any of various arcuate lengths. It is generally contemplated that at least two arcuate segments having different radii are used. By adjusting the number and arrangement of arcuate segments, fluid distribution within the irrigation pattern may be adjusted in a desired manner and the uniformity of fluid distribution in the irrigation pattern may be correspondingly adjusted. The use of compound radii therefore provides flexibility in adjusting fluid distribution within the irrigation pattern. The dimensions and shape of these arcuate segments may be scaled and adjusted, as desired, to fill in various sizes and shapes of irrigation patterns.

An optional feature of the nozzle 100 is a pinch angle defined by the boundary wall 124 at the deflector 112. More specifically, this pinch angle is preferably formed at the top of the boundary wall 124 and preferably defines one side of each boundary flute 174. It is oriented such that the boundary wall 124 extends in a direction away from the rear wall 176. In other words, as shown in FIG. 9, the top portion 124A of the boundary wall 124 preferably defines an inwardly inclined angle of about six degrees (or preferably within the range of two to twelve degrees) with respect to the remainder of the boundary wall 124. It is believed that this pinch angle helps limit the boundary water stream from impacting or adhering to the rear wall 176, reduce precipitation along the boundary edges of the irrigation pattern, and/or limit overthrow beyond the intended throw radius. Further, it is believed that different pinch angles may be desirable for different arcuate spans, e.g., 90 degrees, to fine tune the edges, given lower or higher flow conditions.

Figure 11:
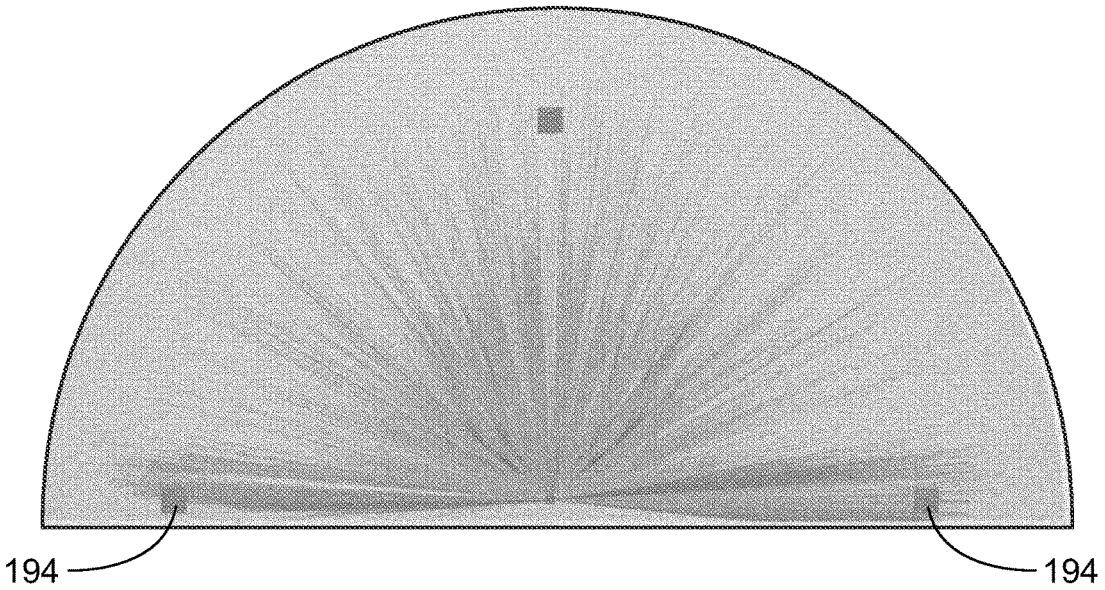
FIG. 11 is a fluid distribution diagram showing the fluid distribution of a conventional nozzle.
Figure 12:
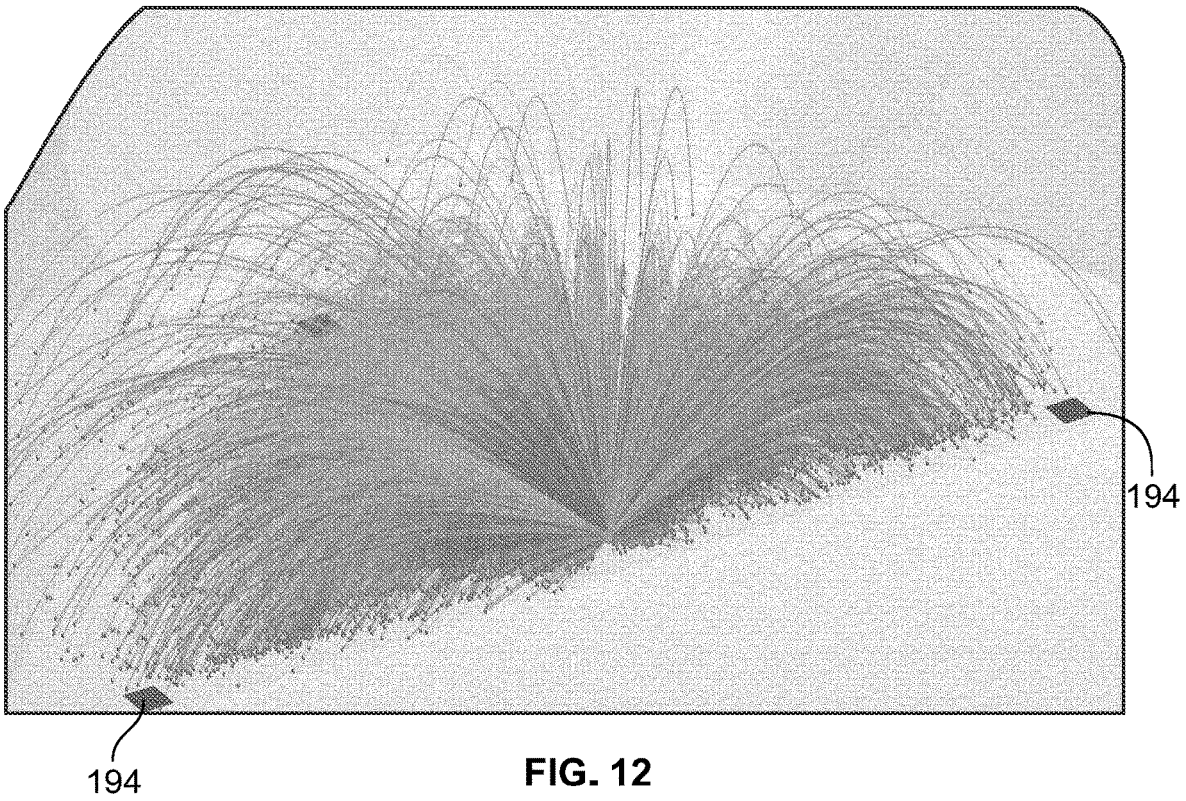
FIG. 12 is a fluid distribution diagram showing the fluid distribution of the nozzle of FIG. 1.

The features described above help improve the uniform distribution of fluid, especially at the boundary edges of the irrigation pattern. FIG. 11 shows an example of the fluid distribution of a conventional nozzle with heavy precipitation and overthrow along the boundary edges of the irrigation pattern. As seen from above, fluid distribution appears relatively heavy along the boundary edges (shown by the dark portions) and appears to overthrow these boundary edges (extending beyond points 194). FIG. 12 shows an example of the fluid distribution of nozzle 100. Fluid distribution is more uniform within the irrigation pattern, and there is little (if any) overthrow at the boundary edges (overthrow beyond points 194).

Several features have been described above to facilitate the uniform fluid distribution and improve fluid distribution at the boundary edges, including vent holes, rear wall offset, port with compound radii, and a pinch angle. It is contemplated that various embodiments of nozzles may include one or more of these features, either in combination or alone. It should therefore be understood that this disclosure does not require the inclusion of any one or more of these features. In certain circumstances, and depending on the nature of the irrigation pattern and other requirements, it may be desirable to exclude one or more features from an embodiment.

Further, the shape of the deflector may be modified to accommodate different fixed arcuate spans, i.e., 90, 270, and 360 degrees. For example, the deflector may include ribs disposed within 90 degrees for quarter-circle irrigation. Additionally, the nozzle body may include two 180 degree deflector surfaces facing opposite from one another to achieve close to full circle (or 360 degree) irrigation. The nozzle body may also include a 90 degree deflector surface combined with a 180 degree deflector surface to achieve 270 degree irrigation. Alternatively, the nozzle body might include two deflector surfaces of approximately the same size to achieve this three-quarter circle irrigation. For these modified embodiments, it may be preferable to have edge flutes to provide a more distant trajectory for water streams at the edges of the pattern.

The nozzle 100 also preferably includes a flow throttling screw 104. The flow throttling screw 104 extends through the central bore 118 of the nozzle body 102. The flow throttling screw 104 is manually adjusted to throttle the flow of water through the nozzle 100. The throttling screw 104 includes a head 148, is seated in the central bore 118 and may be adjusted through the use of a hand tool. The opposite end 150 of the screw 104 is in proximity to the inlet 115 protected from debris by a filter (not shown). Rotation of the head 148 results in translation of the opposite end 150 for regulation of water inflow into the nozzle 100. The screw 104 may be rotated in one direction to decrease the inflow of water into the nozzle 100, and in the other to increase the inflow of water into the nozzle 100. In one preferred form, the screw 104 may shut off flow by engaging a seat of the filter. As should be evident, any of various types of screws may be used to regulate fluid flow.

In operation, when fluid is supplied to the nozzle 100, it flows upwardly through the filter and then upwardly through the inflow port 106. Next, fluid flows upwardly along the conical transition surface 108, which guides the fluid to the ribs 110 of the deflector 112. The fluid is then separated into multiple streams, flows along the rib structures and is distributed outwardly from the nozzle 100 along these flow channels with different trajectories to improve uniformity of distribution. A user regulates the maximum throw radius by rotating the flow throttling screw 104 clockwise or counter-clockwise.

Although the nozzle 100 distributes fluid in a fixed 180 degree arc, i.e., nozzle 100 is a half-circle nozzle, the nozzle may be easily manufactured to cover other predetermined water distribution arcs. Figures showing nozzles with other fixed distribution arcs are easily configured. These other nozzles may be formed by matching the arcuate size of the inflow port with the arc defined by the boundary walls (and with ribs extending therebetween). Further, although the nozzle 100 addressed above includes a one-piece, unitary nozzle body, other embodiments may have a nozzle body that includes several components to define the nozzle body. Various embodiments are described in U.S. Pat. No. 9,314,952, and the patent disclosure is incorporated herein by reference in its entirety.

It will be understood that various changes in the details, materials, and arrangements of parts and components which have been herein described and illustrated in order to explain the nature of the nozzle may be made by those skilled in the art within the principle and scope of the nozzle and the flow control device as expressed in the appended claims. Furthermore, while various features have been described with regard to a particular embodiment or a particular approach, it will be appreciated that features described for one embodiment also may be incorporated with the other described embodiments.

What is claimed is:

1. A nozzle comprising:

an inlet having a predetermined cross-section and configured to receive fluid from a fluid source;

a deflector defining a plurality of flutes arranged in a predetermined arcuate span, the plurality of flutes contoured to deliver fluid radially outwardly from the nozzle in an irrigation pattern corresponding to the predetermined arcuate span;

the plurality of flutes including a first boundary flute and a second boundary flute disposed at first and second ends of the deflector and distributing fluid to two boundary edges of the irrigation pattern;

a plate spaced downstream of the inlet and upstream of the deflector, the plate defining a port therethrough, the port having a cross-sectional area less than an inlet cross-sectional area and having a cross-sectional shape corresponding to a shape of the predetermined arcuate span; and one or more first air vents disposed at the first end of the deflector; and one or more second air vents disposed at the second end of the deflector.

2. The nozzle of claim 1, further comprising:

a boundary wall extending between the plate and the deflector and defining the first and second boundary edges of the irrigation pattern.

3. The nozzle of claim 2, further comprising a distal wall relative to the inlet, the distal wall being radially outward of the deflector, the one or more first air vents and the one or more second air vents extending through the distal wall.

4. The nozzle of claim 3, wherein at least one air vent of the one or more first air vents is disposed to provide air flow between fluid streams exiting the first boundary flute and the boundary wall.

5. The nozzle of claim 4, wherein at least one air vent of the one or more second air vents is disposed to provide air flow between fluid streams exiting the second boundary flute and the boundary wall.

6. The nozzle of claim 2, further comprising:

a rear wall parallel to the boundary wall and extending radially outwardly from the first and second ends of the deflector.

7. The nozzle of claim 6, wherein the rear wall is offset from the boundary wall a predetermined minimum distance.

8. The nozzle of claim 1, wherein:

the plurality of flutes includes at least one non-boundary flute between the first boundary flute and the second boundary flute, and cross-sections of the first boundary flute and the second boundary flute are each approximately half that of the at least one non-boundary flute.

9. The nozzle of claim 1, wherein the cross-sectional shape of the port is oblong and is defined by at least two arcuate segments with different radii.

10. The nozzle of claim 1, wherein the inlet, the deflector, and the plate are collectively part of a unitary, one-piece nozzle body.

11. The nozzle of claim 1, wherein the predetermined arcuate span defines substantially 180 degrees.

12. The nozzle of claim 1, wherein the inlet is defined by a mounting portion of the nozzle configured for mounting to the fluid source.

13. The nozzle of claim 1, further comprising:

a transition surface projecting from a boundary wall extending between the plate and the deflector, the transition surface intermediate of the port and the deflector and guiding flow directed through the port to the plurality of flutes.

14. The nozzle of claim 13, wherein the transition surface is generally conical in shape having a vertex extending toward the port, the transition surface expanding into smoothly curved sides having increasing curvature in a direction toward the deflector.

15. The nozzle of claim 1, wherein the plurality of flutes are configured to subdivide fluid into a plurality of fluid streams with at least three different elevations.

16. The nozzle of claim 15, wherein the deflector includes a plurality of ribs arranged radially to define the plurality of flutes therebetween, each rib including at least two micro-ramps formed therealong to direct the plurality of fluid streams to at least two different elevations.

* * * * *